US009167880B2

(12) United States Patent
Wilson et al.

(10) Patent No.: US 9,167,880 B2
(45) Date of Patent: Oct. 27, 2015

(54) COSMETIC APPLICATORS

(75) Inventors: David Edward Wilson, Reisterstown, MD (US); Gordon Gerald Guay, Chelmsford, MA (US); Laura Elaine Bush, Ellicott City, MD (US)

(73) Assignee: The Procter & Gamble Company, Cincinnati, OH (US)

( * ) Notice: Subject to any disclaimer, the term of this patent is extended or adjusted under 35 U.S.C. 154(b) by 578 days.

(21) Appl. No.: 13/586,428

(22) Filed: Aug. 15, 2012

(65) Prior Publication Data

US 2013/0056019 A1 Mar. 7, 2013

Related U.S. Application Data

(60) Provisional application No. 61/523,588, filed on Aug. 15, 2011.

(51) Int. Cl.

| | |
|---|---|
| ***B05C 17/00*** | (2006.01) |
| ***A45D 34/04*** | (2006.01) |
| ***B05C 17/02*** | (2006.01) |
| ***B05C 17/03*** | (2006.01) |
| ***B05C 17/035*** | (2006.01) |

(52) U.S. Cl.

CPC ..... *A45D 34/041* (2013.01); *B05C 17/00* (2013.01); *B05C 17/0215* (2013.01); *B05C 17/0217* (2013.01); *B05C 17/0308* (2013.01); *B05C 17/0341* (2013.01); *B05C 17/0355* (2013.01); *A45D 2200/055* (2013.01); *A45D 2200/1054* (2013.01); *A45D 2200/1063* (2013.01)

(58) Field of Classification Search

IPC ..... B05C 17/02,17/0202, 17/021, 17/0215, B05C 17/022, 17/025, 17/00, 17/0217, 17/0308, B05C 17/0314, 17/0355; A45D 33/12, 34/04, A45D 34/041, 40/261, 40/26, 2200/055, A45D 2200/1054, 2200/1063

See application file for complete search history.

(56) References Cited

U.S. PATENT DOCUMENTS

| | | | |
|---|---|---|---|
| 3,755,560 | A | 8/1973 | Dickert et al. |
| 4,151,645 | A | 5/1979 | Tietjens |
| 4,233,733 | A | 11/1980 | Gallanis et al. |
| 4,268,499 | A | 5/1981 | Keil |
| 4,274,199 | A | 6/1981 | Gallanis et al. |
| 4,421,769 | A | 12/1983 | Dixon et al. |

(Continued)

FOREIGN PATENT DOCUMENTS

| | | |
|---|---|---|
| DE | 19802770 | 7/1999 |
| EP | 0262535 | 9/1987 |

(Continued)

OTHER PUBLICATIONS

PCT International Search Report dated Oct. 26, 2012—4 pages.

*Primary Examiner* — David Walczak
(74) *Attorney, Agent, or Firm* — Betty J. Zea

(57) ABSTRACT

A multi-functional, multi-compositional cosmetic applicator includes an application surface in liquid communication with a reservoir. The reservoir includes a first personal care composition and a second personal care composition stored therein, and the applicator is actuatable between a first and second functional configuration wherein the application surface of the applicator exhibits a first frictional force when in the first functional configuration and a second frictional force that is less than the first frictional force when in the second functional configuration. The applicator includes an actuatable delivery system that allows a user to selectively dispense the first and second compositions.

9 Claims, 13 Drawing Sheets

(56) References Cited

U.S. PATENT DOCUMENTS

| | | | | |
|---|---|---|---|---|
| 4,446,880 | A * | 5/1984 | Gueret et al. | 132/218 |
| 4,866,843 | A | 9/1989 | Kumano | |
| 4,869,612 | A * | 9/1989 | Mooney et al. | 401/130 |
| 4,896,420 | A | 1/1990 | Locke | |
| 4,922,608 | A | 5/1990 | Pahl | |
| 5,085,856 | A | 2/1992 | Dunphy et al. | |
| 5,685,077 | A | 11/1997 | Mukai et al. | |
| 5,688,831 | A | 11/1997 | El-Nokaly et al. | |
| 6,076,984 | A | 6/2000 | Legrain et al. | |
| 6,082,005 | A | 7/2000 | Tezuka | |
| 6,332,561 | B1 | 12/2001 | Garcia et al. | |
| 6,352,182 | B1 | 3/2002 | Gueret | |
| 6,375,045 | B1 | 4/2002 | Ki | |
| 6,499,898 | B1 | 12/2002 | Garcia | |
| 7,021,495 | B2 | 4/2006 | De Laforcade | |
| 7,458,944 | B2 | 12/2008 | Liste et al. | |
| 8,028,417 | B1 | 10/2011 | Hosseini et al. | |
| 8,308,388 | B2 | 11/2012 | Guay | |
| 8,540,449 | B2 * | 9/2013 | Song | 401/218 |
| 2009/0098170 | A1 | 4/2009 | D'Acchioli et al. | |
| 2009/0249628 | A1 | 10/2009 | Hosseini et al. | |
| 2010/0003205 | A1 | 1/2010 | Elliott et al. | |
| 2010/0003293 | A1 | 1/2010 | Elliott et al. | |
| 2010/0067970 | A1 | 3/2010 | Ki | |
| 2010/0074928 | A1 | 3/2010 | Elliott et al. | |
| 2011/0280647 | A1 | 11/2011 | Wilson et al. | |
| 2012/0222567 | A1 | 9/2012 | McNeil et al. | |

FOREIGN PATENT DOCUMENTS

| | | | |
|---|---|---|---|
| EP | 0 522 624 | A1 | 1/1993 |
| EP | 0522 624 | A1 | 1/1993 |
| JP | 61083110 | | 4/1986 |
| WO | 2009/054612 | A1 | 4/2009 |
| WO | WO 2009/054612 | A1 | 4/2009 |

* cited by examiner

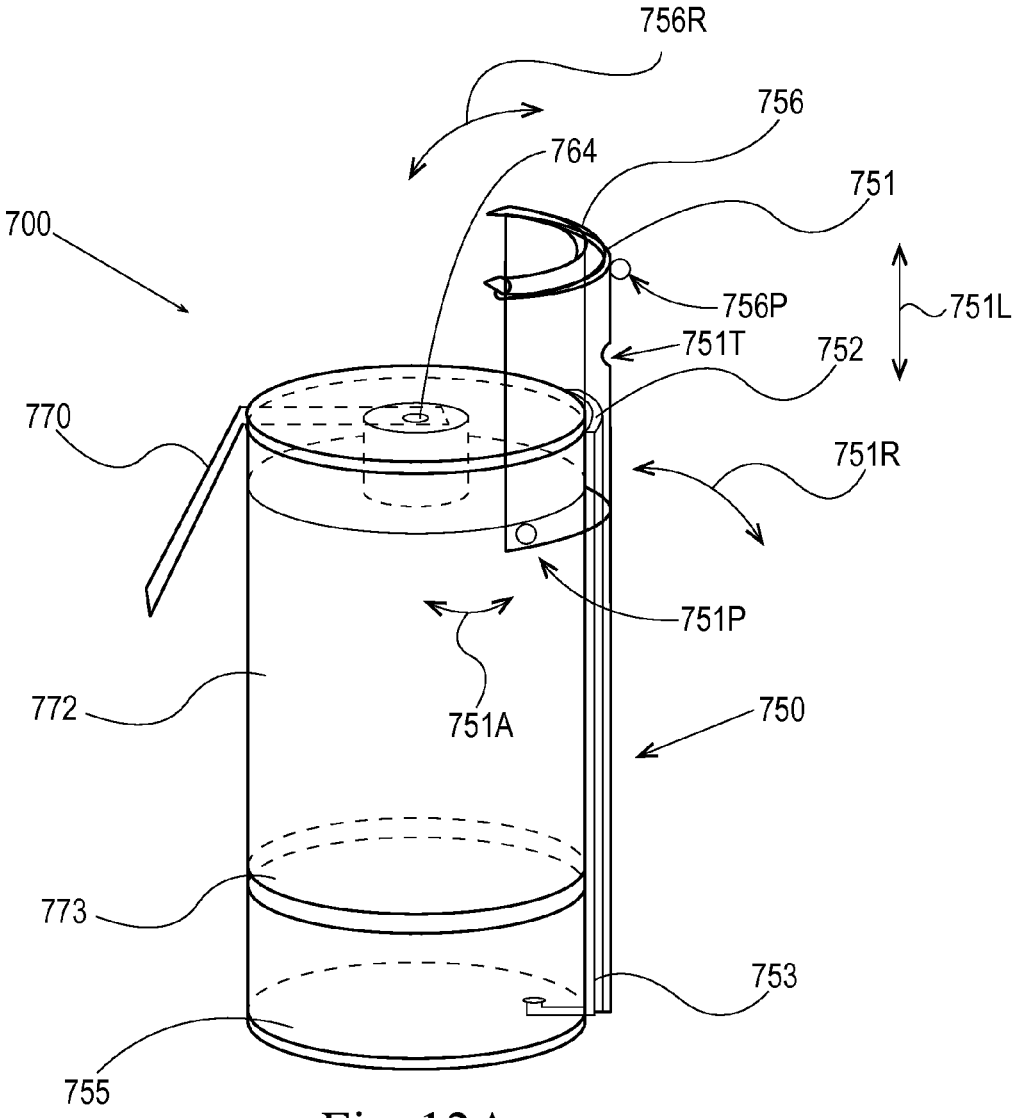
Fig. 12A
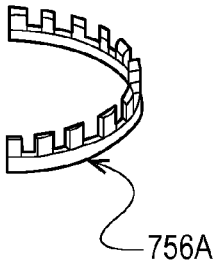
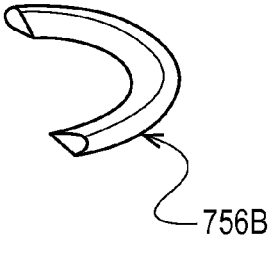
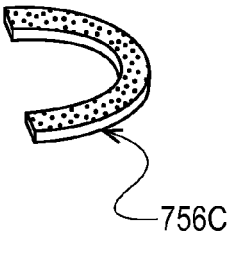
Fig. 12B Fig. 12C Fig. 12D

COSMETIC APPLICATORS

CROSS REFERENCE TO RELATED APPLICATION

This application claims the benefit of U.S. Provisional Application No. 61/523,588, filed Aug. 15, 2011.

FIELD OF THE INVENTION

The present application is directed, generally, to cosmetic applicators. Specifically, there is disclosed an applicator that includes a multi-purpose, cylinder-shaped roller applicator and at least two different personal care compositions. Also disclosed is an applicator that includes a deformable and/or replaceable applicator head for applying a composition to a variety of areas on a target surface.

BACKGROUND OF THE INVENTION

Personal care products are available in a wide variety of packages, including bottles, jars, tubes, and cans. However, there are relatively few personal care products on the market that include built-in applicators wherein a personal care product (e.g., liquid make-up) flows through the applicator to an applicator surface. Some products on the market, such as certain deodorants, employ a roller-ball applicator technique to deliver product. But other personal care products such as cosmetics foundations and lotions are traditionally dispensed out of a container into the hand, a sponge, or some other stand-alone applicator and then applied to the desired bodily surface. Such application methods may be unsanitary, wasteful, and/or messy, and may lead to undesirable post-application cleaning (e.g., hand washing or applicator rinsing).

Conventional applicators are typically not suitable for desirably applying personal care compositions such as cosmetic foundations or lotions to the entire face or other bodily surface. For example, at least some conventional applicators have a relatively wide applicator surface suitable for applying a composition onto the larger areas of the face such as the cheeks and forehead, but not onto smaller skin areas such as the area between the lips and nose. The applicator surface of a conventional applicator is typically not configured to enable a user to change the shape of the applicator surface and facilitate application of the personal care product to the "hard-to-reach" areas of the face and/or other portions of the body.

Further, the applicator surface of a conventional applicator is typically fixed. That is, the position of the applicator surface relative to the rest of the applicator is not intended to be changed. This is problematic because the difference in facial features from one user to another may cause varying pressure to be applied to portions of the applicator surface as it moves across the skin, which in turn may result in the uneven distribution of the composition to the target surface.

Another drawback of conventional applicators is that they are typically configured to apply only a single composition such as, for example, makeup or skin care product, or perform only a single task. Certain features of the applicator surface such as smoothness, roughness, hardness, softness, rigidity, flexibility, effusivity, abrasiveness, tackiness, etc. are tailored to facilitate the application of the single composition or performance of the single task. Prior to the application of a personal care composition (e.g., liquid foundation) to a bodily surface such as the face, is not uncommon for a user to first clean the surface where the composition is to be applied. The user's cleaning regimen may include, for example, scrubbing and/or exfoliating the target skin area to provide a smooth, clean surface for makeup application. It is well known that cleaning and/or exfoliating the skin typically involves the use of a utensil and/or composition that interacts abrasively with the skin surface. For example, some users may use a wet washcloth in combination with a mildly abrasive skin cleanser to provide the desired cleaning experience. But when applying the personal care composition, at least some users desire an applicator with a smooth surface, which may provide a comfortable feeling against the skin and/or may provide the perception of a more even application of the personal care composition. Thus, there is a need for a single utensil that can apply more than one composition and perform more than one task, for example, a utensil that can prepare a target area for application of a composition and then apply the composition.

Accordingly, it would be desirable to provide a cosmetic applicator that delivers more than one composition to a target surface and can perform two or more different functions. It would further be desirable to provide an applicator that can apply a composition to a surface that includes a variety of surface features. It would also be desirable to provide a cosmetic applicator that includes a surface capable of changing its position relative to one or more other portions of the applicator.

BRIEF DESCRIPTION OF THE DRAWINGS

FIG. 12 is a partial cutaway, perspective view of an embodiment of an applicator with a collector.

DETAILED DESCRIPTION OF THE INVENTION

Definitions

Figure 1:
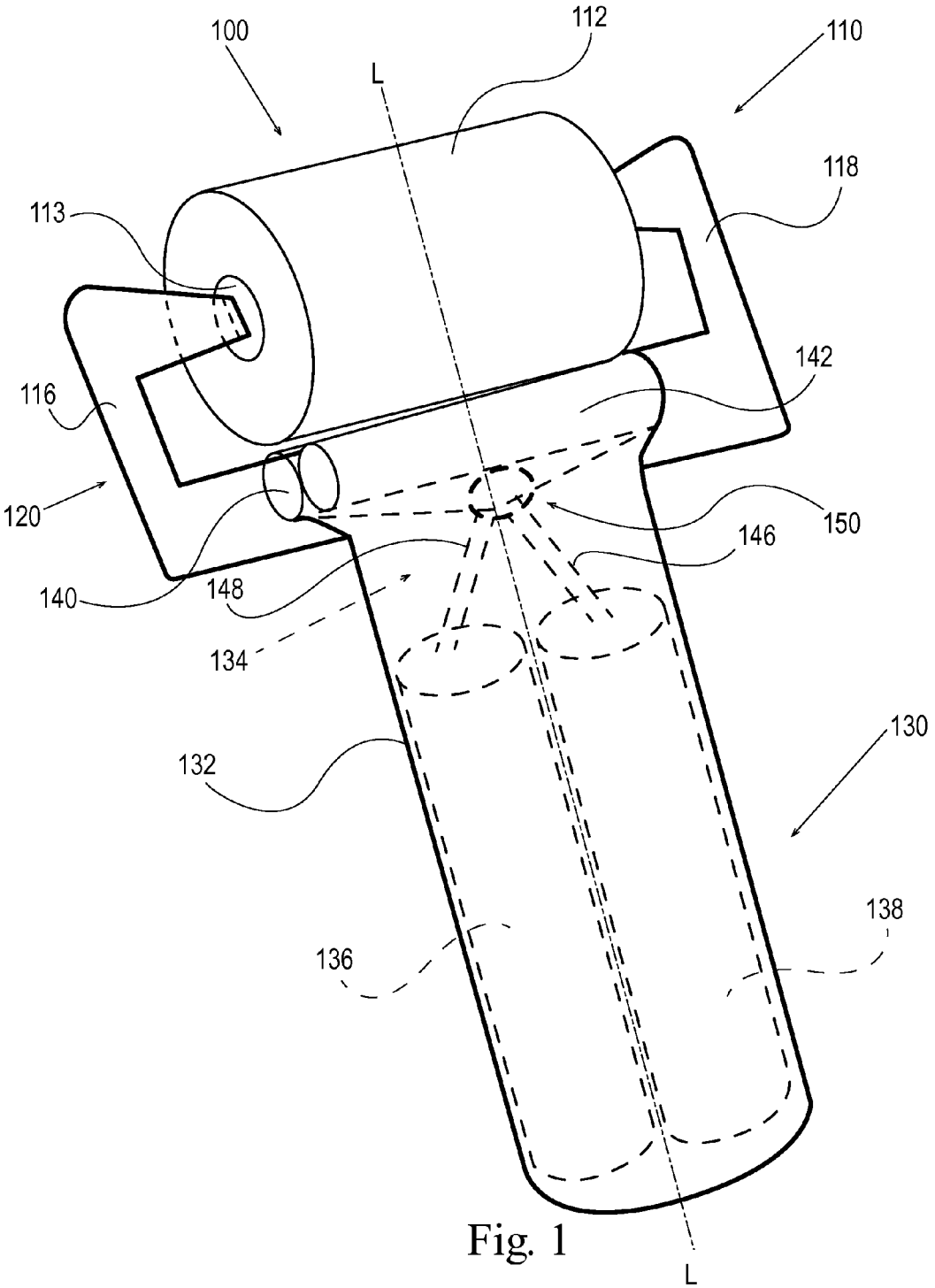
FIG. 1 is a perspective view of an embodiment of an applicator.

"Abrasive" means an article or surface provides a tactile perception of roughness when moved across the skin of user. Alternatively, "smooth" means an article or surface provides substantially no perception of roughness when rubbed on skin.

Actuatable" means the ability of a component or article to be put into mechanical action or motion by manipulating an actuator.

"Compressible" and variations thereof, when used in the context of an application surface, mean the ability of a material, component, or article to decrease in volume without rupture, breakage or other undesirable effect, which would render the material or article unsuitable for its intended use, upon the application of a "compressing force" (i.e., a force which tends to bias the article or material into a compressed configuration) or removal of an "expanding force" (i.e., a force which tends to bias the article or material into an expanded configuration). Conversely, "expandable" and variations thereof, when used in the context of an application surface, mean the ability of a material, component, or article to increase in volume without rupture, breakage or other undesirable effect, which would render the material or article unsuitable for its intended use, upon the application of an expanding force or removal of a compressing force.

"Cosmetic composition" or "makeup" means a composition that is intended to be applied to skin or hair, particularly to the facial skin or hair of a consumer, to improve the aesthetic appearance of the skin or hair. "Liquid makeup" or "liquid cosmetic composition" is a makeup or cosmetic composition that exhibits a particular readiness to flow, little or no tendency to disperse, and relatively high incompressibility.

"Disposed" means an element is positioned in a particular place with regard to another element.

"Elastic" and variations thereof mean the ability of a material to stretch by at least 50% without rupture or breakage at a given load, and upon release of the load the elastic material or component exhibits at least 80% recovery (i.e., has less than 20% set). For example, an elastic material that has an initial length of 100 mm can stretch to at least 150 mm (50% stretch) and, upon removal of the force, retract to a length of 110 mm (i.e., have a set of 10 mm or 10%).

"Foundation" means a cosmetic composition that is intended to be applied to the skin, so to cover and/or mask skin irregularities, skin imperfections, skin discoloration, and/or skin tonal variations (this includes sunscreen and assault protection).

"Joined" means configurations whereby an element is directly secured to another element by affixing the element directly to the other element, and configurations whereby an element is indirectly secured to another element by affixing the element to intermediate member(s) that in turn are affixed to the other element.

"Mechanically coupled" means configurations whereby an element is directly or indirectly mechanically secured to another element. For example, a first element may be joined to a second element via welding, brazing, soldering, jointing, folding, pressing, crimping, snap-fitting, shrink-fitting, expansion fitting, retaining rings, threaded fasteners, pins, rivets, collars, clamps, gears, shafts, chains, springs, pistons, cams, combinations of these and the like. In another example, a first element may be indirectly secured to a second element by mechanically securing the first element to intermediate member(s) that are in turn mechanically secured to the second element.

"Personal care composition" means a composition that is intended to be applied to a bodily surface such as, for example, skin, hair, and/or teeth to regulate the condition (e.g., health and/or appearance) of the bodily surface (this includes sunscreen).

"Pliable" means an article or material is supple enough to bend freely or repeatedly without breaking.

"Resilient" means an article or material that tends to return to its original shape, after being deformed by a force.

For ease of understanding, portions of the following description may be exemplified in terms of a liquid makeup composition, especially a liquid foundation, and the application of such compositions to skin, especially facial skin. However, it is to be understood that while one or more particular examples recited herein may refer to such exemplary embodiments, the cosmetic applicators described herein are not limited to such compositions and/or applications.

An applicator capable of delivering at least one personal care composition to a target surface may include a reservoir for storing (and/or mixing) and dispensing the personal care composition while avoiding cross mixing between the reservoirs through back flow controls. In embodiments where two or more different personal compositions are desired, the applicator may include a first reservoir that stores and dispenses a first personal care composition (e.g., a cleaning composition for cleaning facial skin) and a second reservoir that stores and dispenses a second personal care composition (e.g., a liquid foundation or concealer or skincare formulation). These two chemistries may be reactive when mixed and deliver a third chemistry to the skin or treatment surface after metered mixing and dispensing from the primary reservoirs. In certain embodiments, for example, depilatory hair removal, among others, the applicator may include a collector to remove cleaning fluid or debris prior to application of second or any other subsequently applied personal care composition. Exemplary cleaning compositions include, without limitation, makeup remover, liquid soap, body soap, hand soap, facial cleaner, astringents, and the like. Exemplary makeup compositions include, without limitation, cosmetic foundation, face and body concealer, lipstick, lipstain, topcoat, gloss, eyeshadow, and the like. In certain embodiments, the applicator may include a single reservoir divided into discrete portions, such that two or more personal care compositions can be stored separately from one another. In certain embodiments, the personal care compositions may be selected and/or configured such that they do not intermix with one another (e.g., due to a phase and/or viscosity difference, a difference in hydrophilic and hydrophobic compositions, or a pH differences). In such an embodiment, the two or more personal care compositions may be stored in a single, undivided reservoir, but still dispensed separately. In various embodiments, two or more personal care compositions may be to produce a change in temperature (creating heat or cold), to generate a gas (e.g. foaming), to produce a change in change or viscosity, or to produce a material, such as a film. The personal care compositions are selectively urged from the reservoir to a skin contacting portion of the applicator for application to a target skin surface by an actuatable delivery system, which is described in more detail below.

The applicator includes a skin contacting component that transfers the personal care/cosmetics composition(s) from the reservoir(s) to the skin of a user. In certain embodiments, the skin contacting component may be configured as a rotatable application roller, which includes a suitable application surface for transferring the personal care composition from the roller to the skin. The application roller may take the form of a regular cylinder mechanically and/or adhesively coupled to another portion of the applicator (e.g., applicator head or body) at one or both cylinder ends, such that the roller can suitably rotate. It can be important to properly size the application roller to efficiently and evenly apply the personal care composition(s) to the target surface. For example, a cylindrical roller configured to apply a composition to a user's face or other body surface (e.g., arms, legs, abdomen and the like) may have a length of between 5 and 30 mm (e.g., between 10 and 20 mm or between 12 and 18 mm), and a diameter of between 5 and 15 mm. In this example, a cylindrical roller with a diameter of 5 mm may be configured to deliver between 0.1 and 0.3 $mg/mm^2$ of composition, while the 30 mm diameter roller delivers 2.7-8.1 $mg/mm^2$ of composition to the target surface per 360° of rotation. In this way, a typical user is able to evenly apply the personal care composition. It is to be appreciated, of course, that the rotatable application roller may be configured in any suitable shape, as desired (e.g., spherical, conical, frustoconical, multilobal), as long as the application roller is able to deliver the personal care compositions in the desired manner. In certain embodiments, the skin contacting component may include a non-rotating application surface such as, for example, a commonly known apertured foil surface. Apertured foil surfaces are commonly known for use with the electric shavers such as those described in U.S. Pat. Nos. 4,896,420; 6,082,005; 5,685,077; 4,922,608; 4,866,843; 4,233,733; and 4,151,645.

In certain embodiments, the present applicator may be selectively operated to perform two or more different functions by a user. For example, the applicator may include a functional selector (e.g., switch, button, lever, trigger, and the like) that enables a user to switch between a low-resistance mode of operation and a high-resistance mode of operation. This selector mode may render varying amounts of product or may provide varying amounts of abrasion to the treatment area. When two products are to be dispensed, the functional control may be used to precondition the treatment surface to increase penetration of chemistry or increase or decrease the chemical bond with the treatment surface. The functional selector may be configured to require continuous actuation (e.g., "press and hold") to maintain the applicator in the desired mode of operation and/or "one-time" actuation (e.g., "flip the switch"). In certain embodiments, the function selector may be in the form of a button or lever that, when depressed or squeezed by user, causes a brake to be applied to a rotatable roller. Alternatively or additionally, the function selector, when actuated by a user, may remove or decouple a brake or other resistive force from the roller thereby permitting its unimpeded rotation.

It is believed, without being limited by theory, that depending on how freely the roller rotates, the deposition topography of the personal care composition, the homogeneity of the deposition film, and the amount of product of product applied, which all affect whether the composition appears smooth and/or even on the skin, can be controlled. In the low-resistance mode of operation, the application surface may be permitted to move over the target surface with little or no resistance so that a user perceives the application surface as gliding relatively smoothly and/or effortlessly over the skin. The frictional force observed at the application surface of the roller should be low relative to the high resistance mode of operation, but still sufficient to desirably deliver the personal care composition to the target surface. In certain embodiments, the low-resistance mode of operation may include a rotatable roller that is permitted to rotate freely. In the low resistance mode of operation, the applicator may be used to apply a cosmetic or personal care composition such as a cosmetic foundation or concealer.

In the high-resistance mode of operation, the application surface is perceived by a user as feeling abrasive and/or harder to move across the skin relative to the low-resistance mode of operation. In certain embodiments, the high-resistance mode of operation may include a brake or other similar component that is used to apply a resistive force to an otherwise freely rotating roller. The brake or other similar device impedes or may even prevent the roller from rolling smoothly (or even rolling at all) across the target surface. In the high-resistance mode of operation, the applicator may be used as a cleaning tool or application of formulation with greater force to enhance product rub in. For example, the roller may be paired with an optional cleaning composition to clean and/or exfoliate the skin of a user. The reduced ability or even inability of the roller to rotate in the high-resistance mode of operation may cause the frictional force observed at the application surface of the roller to increase, thereby providing an improved cleaning and/or exfoliating benefit. Providing a roller with relatively large sidewalls (e.g., by selecting a particular roller diameter) may also provide a means for increasing drag and abrasion.

It may be desirable to configure the applicator to have a predetermined ratio of frictional force in the low-resistance and high-resistance modes of operation. This ratio may be important for effectively communicating a contrast between the two modes of operation to a user, and to enhance a user's awareness that each mode of operation is particularly suited for the function selected.

It is important to select a material for the application surface that is capable of providing both an abrasive and a smooth feeling when moved across the skin of a user, depending on the configuration of the applicator (e.g., low-resistance or high-resistance mode of operation). This action may be used to pull or stretch the skin as a pretreatment for chemical delivery that can lock or hold the repositioning/tensioning of the skin for longer periods of time. It is also important to form the application surface from a material that provides a capillary pressure gradient sufficient to receive and retain a liquid personal care composition, yet still be able to transfer the composition to the target skin surface as intended. As an example, the application surface could be compressible surface with voids. It may be desirable to form the application roller from an expandable/compressible and/or elastic material so that the shape of the roller may be adjusted depending on the surface features and/or contour of the target surface. Such surfaces may be pretreated or treated in suture with relatively abrasive particles that act as abrasives. The relative abrasiveness of the surface may be changed by stretching or compressing the surface. Non-limiting examples of suitable materials for the application surface of the present application include textile materials like Spandex and foam materials of polyurethane, melamine, cellulose, PVC, polystyrene, polyester, polyurethane, silicone, rubber, neoprene, silicone rubber, polyimide, polyethylene. In various embodiments, the application surface could also include a gel reservoir that changes shape and/or hardness with volume changes to the reservoir. In certain embodiments, the application surface may be formed from an open and/or closed cell foam substrate that is between 1.5 cm and 2.5 cm thick for facial applicators or greater than 2.5 cm for body applicators. In certain embodiments the application surface may be a composite of various materials laminated or welded together to offer varying absorbance and resilience. In certain embodiments, the application surface may be a sleeve having a thickness of between 0.5 mm and 3 mm (e.g., nylon), which is placed over a solid or ribbed frame or similar understructure. The application surface may be disposable or replaceable, after one or more uses.

In embodiments where the application surface is in the form of a rotatable roller, it may also be desirable to configure the application roller to be movable or pivotable in a way that resembles the movement of an airplane about its "yaw" axis, thereby permitting the application roller to turn without disrupting the contact between the application surface and the skin. Additionally or alternatively, the application roller may be at least partially rotatable about the longitudinal centerline such that the movement of the application roller resembles the movement of an airplane about its "roll" axis. In such an embodiment, the ends of a cylindrical roller are capable of moving opposite one another (i.e., one side can move up while the other moves down), thereby permitting the application roller to more evenly apply a composition to an uneven surface.

The present applicator may include an actuatable delivery system for transferring the one or more personal care compositions from the reservoir to the application surface. When the applicator includes more than one personal care composition, the actuatable delivery system may include a composition selection mechanism that enables a user to select from the various personal care compositions stored in the reservoir(s) the particular composition to be dispensed. The actuatable delivery system includes an actuator such as, for example, a lever, button, switch or other discrete, manipulatable component disposed conspicuously or inconspicuously on the applicator, which, when actuated, causes a personal care composition to be expelled from the reservoir(s) of the applicator. This actuation and chemistry delivery may also be induced by pushing the applicator against the treatment area, by rolling the applicator across the surface, and/or by pushing back and forth in a circular motion and thus inducing capillary action (e.g. for a Gradient Foam applicator). Further, the actuation and chemistry delivery may be provided by positive displacement pumps, gear pumps, and/or peristaltic pumping mechanisms (e.g. driven by the motion of application). Alternatively or additionally, the personal care composition may be expelled by applying pressure directly to the applicator body and/or reservoir itself, for example, by configuring the applicator body and/or reservoir as a "squeeze tube." In a particularly suitable example of an embodiment, an airless pump may be used to expel the personal care composition(s) from the reservoir(s). Airless pumps are generally used to pump a substance from a reservoir in essentially a single direction without permitting the reverse flow (i.e., intake) of air via the pump. That is, as product is pumped from the reservoir, the pumped product is not replaced with a corresponding volume of air through the pump. It is not uncommon for airless pumps to be used in conjunction with a one-way valve such as a check valve to prevent or at least reduce the intake of air and other substances that would otherwise replace the volume of personal care composition expelled from the reservoir. Airless pumps such as diaphragm pumps, piston pumps, squeeze tubes, and vented dip tube pumps typically rely on manual actuation by a user and/or stored potential energy (e.g., battery; spring; or elastic band, tube, or other elastic element) to generate pressure. Suitable examples of airless pumps for use herein are disclosed in U.S. Pat. Nos. 6,375,045, 6,332,561, 6,352,182, 6,499,898; and 7,021,495; and PCT Publication Nos. 2009/028810 and 2009/054612. Also, a delaminating pouch can be used as a delivery system.

In certain embodiments, the application surface may be in direct liquid communication with the reservoir(s). That is, the personal care composition is transferred directly from the reservoirs(s) onto the application surface of the applicator. Exemplary direct delivery systems are disclosed in published U.S. Patent Application 20110280647, filed by Wilson, et al., on May 24, 2011. Also, this transfer could be accomplished through the use of gradient foams, such as those disclosed in published U.S. Patent Application 20090180826, filed by Guay on Jan. 8, 2009. Additionally or alternatively, the actuatable delivery system may include one or more intermediate delivery elements, which are each configured to receive a personal care composition from the reservoir(s) or another intermediate delivery element and transfer the composition to the application surface or another intermediate delivery element. For example, the applicator may include a first transfer roller and a second transfer roller positioned proximate the surface of a rotatable application roller. The first and second rollers may be configured as rotatable cylinders, each with an axis of rotation that is generally parallel to the axis of the other transfer roller and the axis of the application roller. The surfaces of one or both transfer rollers or portions thereof may be in continuous or intermittent physical contact with the surface of the skin contacting portion, or the transfer rollers may be positioned such that they do not contact the application surface at all, but still provide suitable transfer of the personal care composition to the application surface. In various embodiments, a transfer roller can also include a reservoir.

The application roller and/or one or more of the transfer rollers may include a patterned surface. The pattern may be formed by one or more of the same or different surface features, such as a three-dimensional texture. The surface features may be the same or different size, type (e.g., protrusion versus recess versus aperture), or shape (e.g., elliptical, circular, diamond, square). The surface features may be selected to facilitate the transfer and/or application of the personal care composition onto the skin of a user. The pattern may be in the form of discontinuous dots, lines, and/or shapes; a continuous matrix; and/or a combination of these. The surface pattern on the roller produces a corresponding pattern on a target surface (e.g., skin or another roller surface) when the personal care composition is applied thereto. In certain embodiments, the applicator may include an application roller with a patterned application surface that is configured to deliver a discontinuous film of product to the skin of a user, which results in natural looking coverage. A surface pattern may be formed on a roller by providing apertures that extend through the surface of the roller (from an internal to an external portion). Alternatively or additionally, the pattern may be formed from recessed and/or raised portions disposed on the surface of the roller. In certain embodiments, the personal care composition may flow through the apertures of the pattern onto the application surface during dispensing and/or application. In certain embodiments, (e.g., if the surface pattern includes raised portions), the raised areas may pick up the personal care composition from, e.g., a trough or tray positioned in close proximity to the surface of the roller. In embodiments where the skin-contacting surface includes recessed portions disposed on its surface, the personal care composition may be deposited in the recessed portions and subsequently transferred to the skin of a user. Exemplary surface patterns and rollers that include such surface patterns are disclosed in copending U.S. Ser. No. 13/114,257, filed on May 24, 2011 by Wilson, et al.; and U.S. Ser. No. 13/040,287, filed on Mar. 4, 2011 by McNeil, et al. In one embodiment, when the application surface is adjusted to a retracted shape, the application surface can have a surface pattern formed by a rigid material that contacts an underside of the application surface.

The applicator may include a handle that is graspable by a user. The handle may include suitable ergonomic and/or aesthetic features known for use with handheld devices, especially those used to apply a personal care composition to skin. The handle may include an internal compartment that contains the reservoir(s) of the applicator. The reservoir(s) may be integral components that are formed separately from the applicator and/or handle and then placed in the handle storage compartment. In certain embodiments, the reservoir(s) may be removable, replaceable, and/or disposable. For example, the handle may include a door or similar feature that can be opened by user to access all or a portion of the storage compartment and the reservoir(s) stored therein. In this way, the reservoir(s) can be removed or replaced, for example, when the supply of personal care composition is depleted or a different personal care composition is desired by the user. Additionally or alternatively, the one or more reservoirs may be disposed on an outer surface of the applicator or applicator body, for example, in a snap-fit type of arrangement. In another example of an embodiment, the handle may include a cap on the end of the handle that can be removed by a user (e.g., a threaded, screw cap). In this example, when the cap is removed the reservoir(s) may be removed and/or replaced by a user. Alternatively, the handle compartment may be permanently sealed such that a user cannot access it without damaging the applicator. In such an embodiment, the entire applicator may be disposable or only the handle may be disposable (i.e., the entire handle may be replaceable). In certain embodiments, the reservoir(s) may be unitary features formed in the handle compartment during manufacture of the applicator and/or handle. The unitary reservoir(s) may be defined by one or more walls that extend from the internal surface of the handle compartment. This handle compartment may be squeezable or rigid.

In certain embodiments, it may be desirable to position certain features on the outer surface of the handle, such as a function selector, composition selector, pump actuator, and/or a locking mechanism that prevents a user from inadvertently changing the selected function or composition and/or discharging a personal care composition. The handle may also include indicia to provide a visual cue to user related to one or more features of the applicator, for example, how to access or use the features. The visual cue may be verbal or non-verbal.

In various embodiments, the applicator can provide variable softness/hardness. As depicted in FIG. 1, changing the applicator from broad to more precise or focused could leverage changes in surface hardness of the applicator. In the general, applicators can be created that are soft and compliant and, as the applicator is changed to more precise the applicator surface becomes more stiff.

In various embodiments, the applicator can provide variable surface roughness (e.g. changing applicator abrasivity). An applicator surface attached to a delivery system could have abrasive elements associated with the surface. In the broad configuration, the particles are close together and provide substantial exfoliation but as the applicator is dialed up into a more fingertip-like configuration, the abrasive particles become more spread out to reduce the level of abrasivity of the applicator surface. In addition, finger like abrasive surfaces attached to, or below a woven surface can be re-positioned as the surface is re-configured from the flat rest position to stretch geometries. This would allow for abrasive and non abrasive settings.

In various embodiments, the applicator can provide modifiable surface patterns. Since the applicator surface can be changed and stretched, the three dimensional pattern on an applicator surface can also be changed by changing the surface from flat to cone-like which will change the distance between any 3-D structures present on the applicator head resulting in a different deposition pattern In various embodiments, the applicator can provide a variation in three-dimensional surface structure to enable changes in the thickness of product applied to skin. Through changes in the three-dimensional profile of the applicator surface as a result of moving from a general to more cone like applicator, the thickness of the film deposited on skin can also be modified. In addition to typical woven and elastic surfaces, bristled or fingered rubber surfaces can be added to provide scrubbing action for use as a body wash dispenser in larger sized units.

In various embodiments, the applicator can provide an applicator surface that could be "Seamlessly modified" from flat to conical to offer broad and finite control of the surface being applied to.

In various embodiments, the mechanism is meant to be placed on a reservoir to allow flow through product delivery to avoid dipping or re-loading of the surface. The applicator may be re-dosed continuously without a break in usage. As a result, the reservoir has been combined with the applicator for single handed use throughout the application experience.

FIG. 1 shows an exemplary embodiment of an applicator 100 suitable for applying a personal care composition to skin such as facial skin. The applicator 100 includes a head 110 joined to a body 130 and a longitudinal centerline L. As shown in FIG. 1, the head 110 may include an application surface in the form of a rotatable application roller 112 mechanical coupled to a support frame 120. Each rotatable roller disclosed herein is configured to rotate around an axis of rotation, as will be understood by one of skill in the art. The support frame 120 shown in FIG. 1 includes two opposing arms 116, 118 mechanically coupled to opposing sides of the rotatable application roller 112 such that the application roller 112 is rotatable while the arms 116, 118 are not. Any suitable means known for mechanically coupling a fixed component to a rotating component may be used. For example, the arms 116, 118 may be joined to a shaft that extends lengthwise through an opening 113 in the applicator roller 112. In certain embodiments, the application roller 112 may include a ball bearing assembly at one or both ends that are operatively joined to the shaft and the applicator roller 112, thereby providing a means for rotation. The applicator 100 shown in FIG. 1 includes a handle 132 extending away from the head 110 of the applicator 100, with an elongated direction parallel to the longitudinal centerline L, and suitable for grasping by a user. The handle 132 includes a storage space 134 therein, which is configured to receive and store one or more reservoirs 136, 1.38. The applicator 100 may include one or more rotatable transfer rollers 140, 142. As shown in FIG. 1, the transfer rollers 140, 142 are configured to receive a personal care composition from the reservoirs 136, 138 and transfer the personal care composition to the rotatable application roller 112. The personal care composition may be transferred from the reservoirs 136, 138 through, e.g., a suitable transfer tube 146, 148 or the like. Additionally or alternatively, a manifold 150 or other similar feature may be included to provide mixing of multi-stream fluids or flow control for discrete material delivery for even distribution of the personal care composition on the surface of the transfer roller 146, 148.

The applicator 100 above provides an improved apparatus for applying multiple personal care compositions to skin as well as performing multiple functions. However, some body surfaces such as a human face are uneven. As a result, an application surface such as the application roller 112 exemplified above may experience an uneven distribution of pressure along the portion of the application roller 112 contacting the skin. Any unevenness in pressure on the application roller 112 may result in an uneven application of the personal care composition onto the skin. Additionally, some users may find it difficult to apply a relatively uniform pressure to an applicator as they move the applicator roller 112 across their face or other body area. In order to provide a solution to this problem, it may be desirable to provide a personal care applicator that compensates for uneven pressure on the application roller 112.

Figure 2:
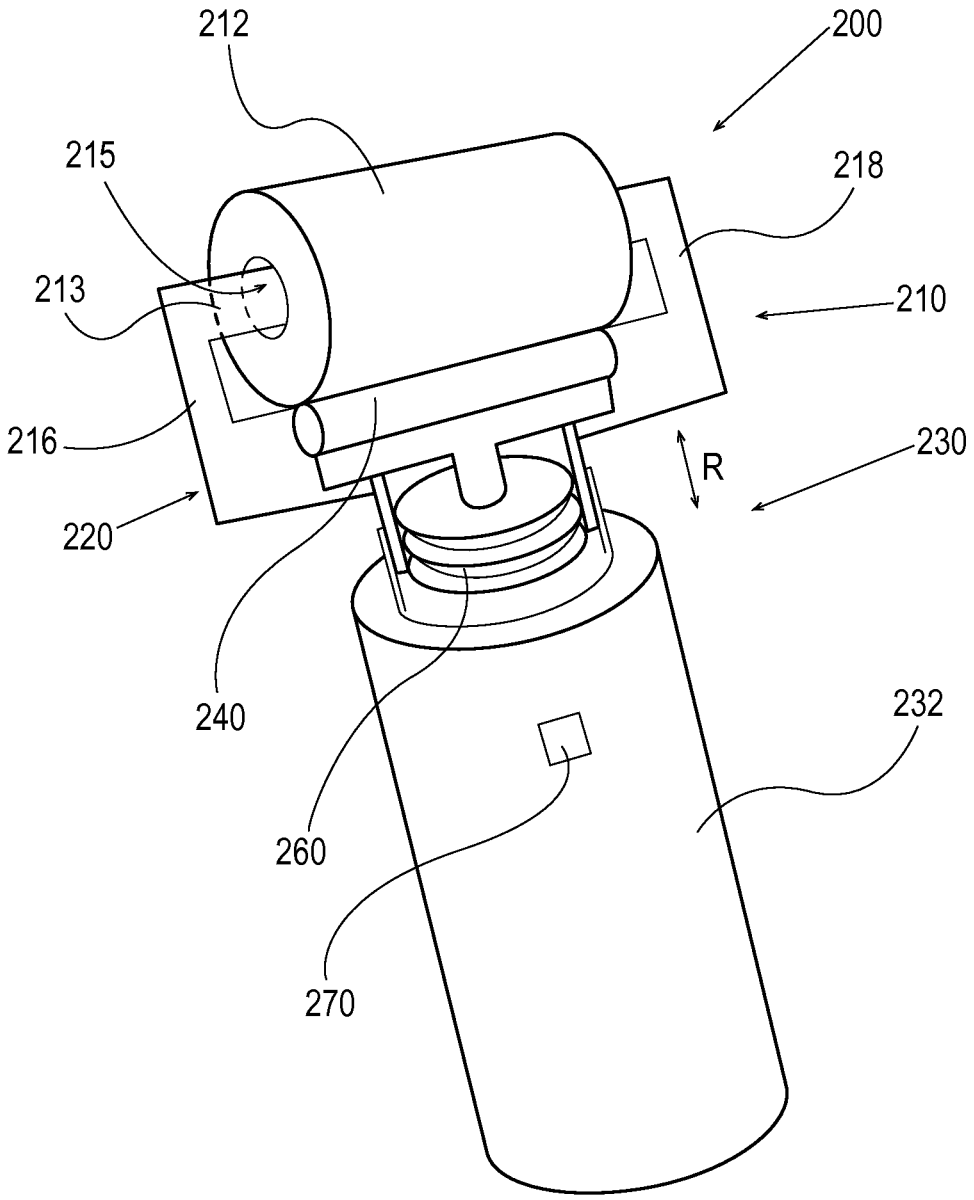
FIG. 2 is a perspective view of an embodiment of an applicator.

FIG. 2 shows an exemplary embodiment of an applicator 200 that compensates for the various features and/or contours found on a target surface such as the face. The applicator 200 includes a head 210 and a body 230. The applicator head 210 includes a rotatable application roller 212 mechanically coupled to a support frame 220. The rotatable application roller 212 rotates about a shaft 213 extending lengthwise through an opening 215 in the rotatable roller 212. The shaft 213 may be a unitary shaft 213, or may be formed from two or more discrete components joined together to form the shaft 213. In certain embodiments, the applicator 200 may include one or more ball bearing assemblies in a suitable configuration to facilitate rotation of the application roller 212 and, optionally, the shaft 213. As shown in FIG. 2, the shaft 213 may be joined to the opposing arms 216, 218 of the support frame. In certain embodiment, the shaft 213 may be formed as part of a unitary support frame 220. The body 230 of the applicator includes a handle 232. Within the handle 232 are one or more reservoirs, each containing a personal care composition. The personal care composition(s) is urged out of the reservoir, for example, by manipulating the actuator 270 on the handle 232 of the applicator 200. The personal care composition(s) is transferred to the surface of the transfer roller 240. The transfer roller 240 then transfers the composition to the surface of the application roller 212 (e.g., via a capillary pressure gradient between the surface of the transfer roller 240 and the surface of the application roller 212). Positioned between the body 230 and head 210 of the applicator 200 is a pressure distributor 260. The pressure distributor 260 permits the applicator roller 212 or the entire applicator head 210 to move in a radial direction R (i.e., towards and away from the body 230 of the applicator 200), thereby compensating for the uneven pressure distribution that may be encountered when rolling the applicator roller 212 across an uneven target surface. In certain embodiments, the pressure distributor 260 may be in the form of a bellows spring that has a predetermined spring constant selected to compensate for the pressure typically associated with rolling an application roller across a human face or other body surface. For example, the spring constant can be configured to provide 20-200 grams of force. It is to be appreciated that the pressure distributor 260 is not limited to bellow springs but may include any material that provides suitable elastic deformation and/or resistance, such as elastically expandable and compressible foam.

As mentioned previously, certain bodily surfaces such as the human face have a variety of features and contours which tend to produce an overall uneven surface. For example, the portion of the face where the cheek meets the nose forms a relatively narrow crevice, while the cheek itself tends to provide a relatively large, even target surface. Other areas of the face such as the area of the face between the nose and upper lip, the area between the nose and eye, and the area between the lower lip and chin all provide their own unique topographical characteristics. As a result of attempting to apply a personal care composition such as makeup to "hard-to-reach" or uneven areas of the face, the applied composition may not provide the desired benefit (e.g., hiding imperfections). Thus, it may be desirable to provide an applicator that enables a user to evenly apply a personal care composition to different areas of the face.

Figure 3:
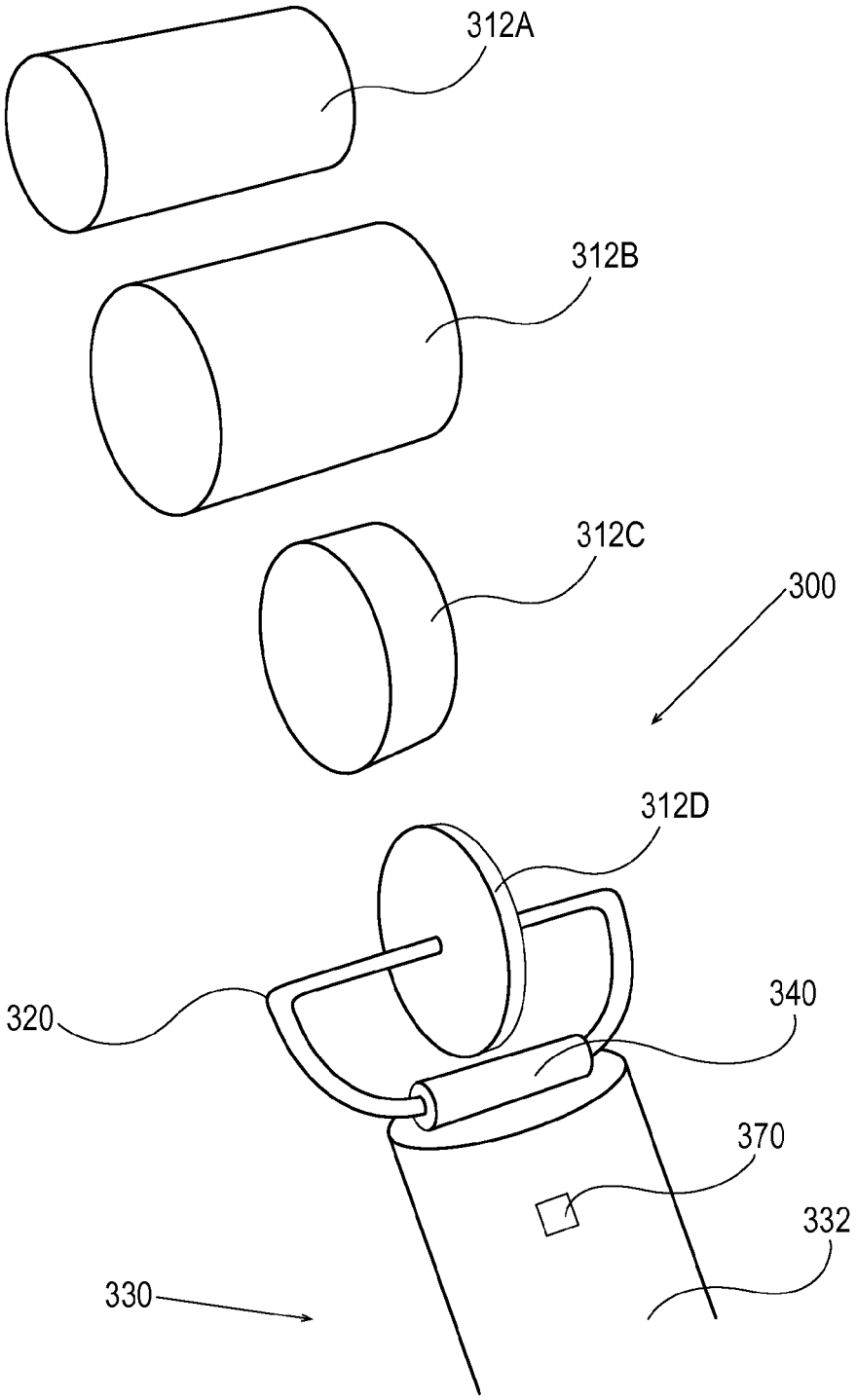
FIG. 3 is a perspective view of an embodiment of an applicator.

FIG. 3 shows an exemplary applicator 300 that includes an application surface in the form of four removable and reattachable application rollers 312A, 312B, 312C, and 312D. The application rollers 312A-D may be alternately joined to a support frame 320 one at a time. The support frame 320 is joined to the body 330 of the applicator 300, for example, via mechanical coupling or as unitary feature. The applicator 300 may include a transfer roller 340 that receives a personal care composition from a reservoir or other intermediate component and transfers the personal care composition to the application roller 312. In various embodiments, transfer roller 340 can include a masking sheath to selectively limit the portion of the applicator roller to which a personal care composition is provided.

The personal care composition may be urged from one or more reservoirs by an airless pump, which is actuated, for example, by a button 370 disposed on the handle 332 of the applicator 300. The removable and reattachable rollers 312A-D may be separately joined to the support frame 320, for example, by snap fitting, to provide a range of application configurations to address different application needs. Accordingly, in a group of removable and reattachable rollers, rollers may differ from each other in size (width and diameter), shape, application surface, and/or other structure, including any embodiments disclosed herein and/or known in the art.

For example, the first application surface configuration 312A provides an application surface resembling a cylinder (i.e., a shape having a length that is greater than its diameter), which is more suitable for applying a personal care composition over a relatively large surface area on the body. But the first configuration 312A may not be suitable for applying a personal care composition to a hard-to-reach area. In contrast, the fourth application surface configuration 312D provides an application surface resembling a disc (i.e., a shape having a diameter that is substantially greater than its length in the longitudinal direction, e.g., 10×, 20×, 100×, or more). By placing a personal care composition on the relatively narrow edge of the disc-shaped application surface 312D, the personal care composition may be applied more easily and effectively to hard-to-reach areas of the face and body of a user. In certain embodiments, the applicator 300 may include a first and second intermediate configuration 312B and 312C for applying a personal care composition to areas of the face and/or body that fall in between the extremes of easy-to-reach and hard-to-reach.

It is to be appreciated, of course, that the applicator 300 may include any number of intermediate configurations, which may provide a user with an applicator surface more suited to applying a personal care composition to particular area of a target surface. The, interchangeable application rollers 312A-D may be reusable or disposable, and may be marketed in the same package as the applicator 300 and/or sold separately, as desired. The exemplary embodiment disclosed herein is directed to non-adjustable, interchangeable application rollers, but it is to be appreciated that embodiments wherein the application rollers 312A-D are adjustable are also contemplated herein. For example, the interchangeable applications rollers 312A-D may be used in conjunction with one or more of the adjustable positioning systems described in more detail below.

In various embodiments, the applicator 300 can also include a group of two or more removable and reattachable transfer rollers, such as 340, which may be alternately joined to the support frame 320 one at a time. In a group of removable and reattachable transfer rollers, rollers may differ from each other in size (width and diameter), shape, application surface, and/or other structure, including any embodiments disclosed herein and/or known in the art. As an example, a plurality of transfer rollers can be provided for corresponding use with one application roller. As another example, one transfer roller can be provided for corresponding use with one application roller, and multiple pairs of such corresponding rollers can be provided. As a further example, one transfer roller can be provided for corresponding use with a plurality of application rollers.

In alternative embodiments, a transfer roller, support frame, and application roller can be joined together as a removable and reattachable applicator head, and a plurality of different applicator heads can be provided for the applicator 300, to allow the use of different applicator heads for different application needs. For each applicator head, the transfer roller and the application roller can be selected from any embodiment disclosed herein, to provide varying kinds of application performance.

Figure 4A:
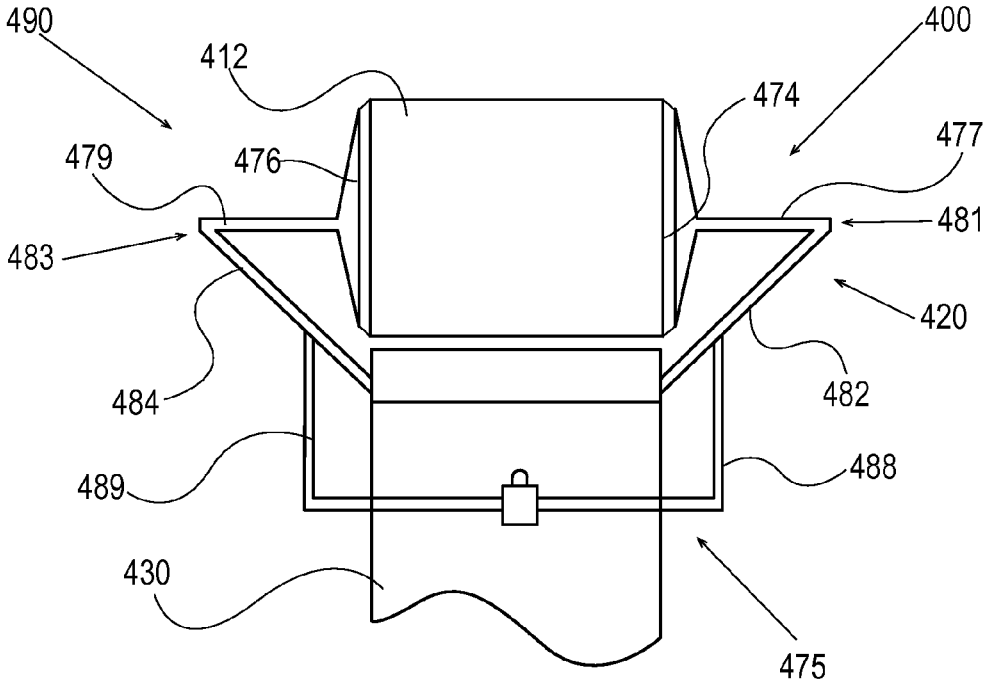
FIGS. 4A and 4B are plan views of an embodiment of an applicator.
Figure 4B:
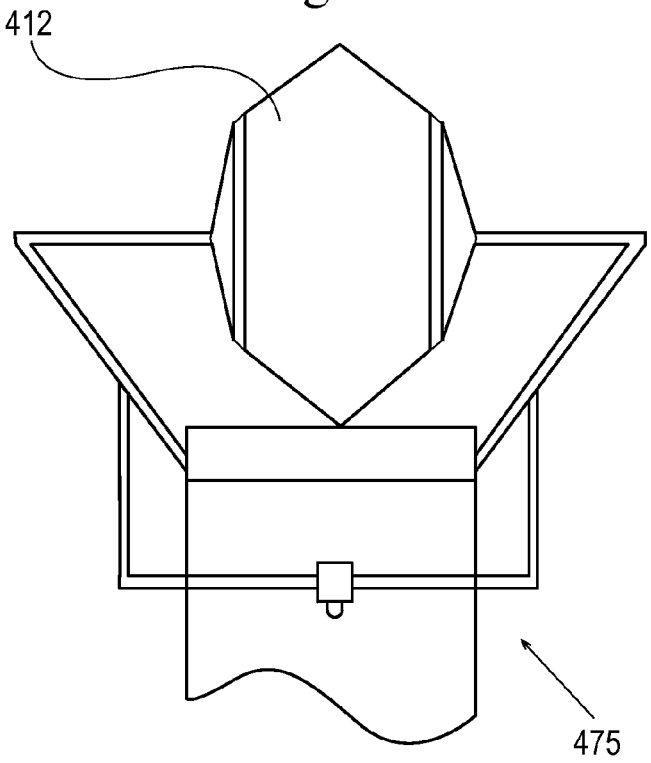

FIGS. 4A and 4B show an exemplary embodiment of an applicator 400 that includes an external, adjustable positioning system 490, which can be manipulated by a user change the configuration of the application roller 412. As used herein, in conjunction with the adjustable positioning system 490, the term "external" means that the adjustable positioning system 490 is disposed entirely outside of the application roller 412. The adjustable positioning system may include two or more compression elements 474, 476 positioned on opposite ends of the application roller 412. Optionally, one or both compression elements 474, 476 may be releasably and/or reattachably joined to the application roller 412. The compression elements 474, 476 are operatively joined to a position selector 475 via a support frame 420. When the position selector 475 is manipulated by a user as intended, the compression elements 474, 476 are urged toward one another such that they apply a compressing force to the roller 412. When the application roller 412 is formed from a pliable or compressible material, the shape of the roller 412 will change as the compression elements move toward one another, as illustrated in FIG. 4B. In certain embodiments, the position selector 475 has a first position and second position, which can be freely selected by a user to switch between the wider application roller 412 illustrated in FIG. 4A and the narrower application roller 412 illustrated in FIG. 4B. Of course, it is to be appreciated that the positioning system 490 may be configured to provide more than two different positions (e.g., 3, 4, 5, or any number of intermediate positions between a fully extended and fully compressed position), as desired.

In certain embodiments, the positioning system 490 may include first positioning arm portions 477, 479, which each extend from a bend 481, 483 toward a compression element 474, 476, and second positioning arm portions 482, 484, which extend from a bend 481, 483 toward the body 430 of the applicator 400. It may be desirable to arrange the first positioning arm portions 477, 479 and second positioning arm portions such that they form an angle of less than 90° when the application roller 412 is fully extended (i.e., completely uncompressed). Although, angles of 90° or greater are also contemplated herein. The second positioning arm portions 482, 484 may be joined to first and second selector arms 488 and 489, respectively. The position selector 475 may include a button or switch mechanically coupled to or unitarily formed with the first and/or second selector arms 488, 489. When the switch is moved from a first position to a second position by a user as intended, a force is transmitted to the selector arms 488, 489 and the positioning arms which causes the compression elements 474 to squeeze the application roller 412 to be compressed.

Figure 5A:
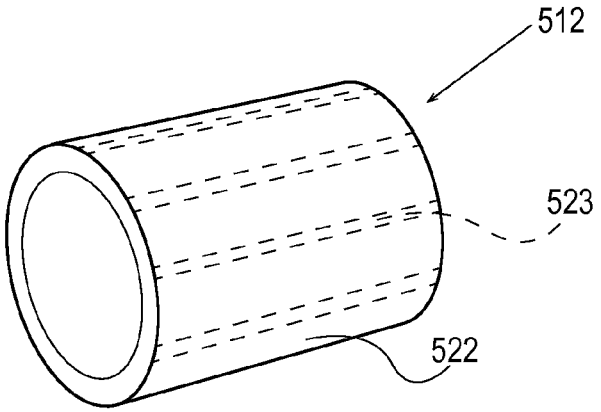
FIGS. 5A, 5B, and 5C are perspective views of an embodiment of an adjustable application roller.
Figure 5B:
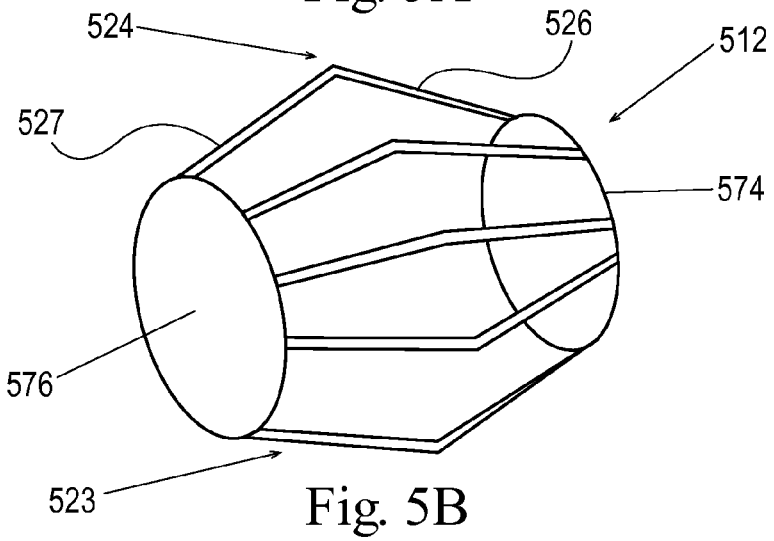
Figure 5C:
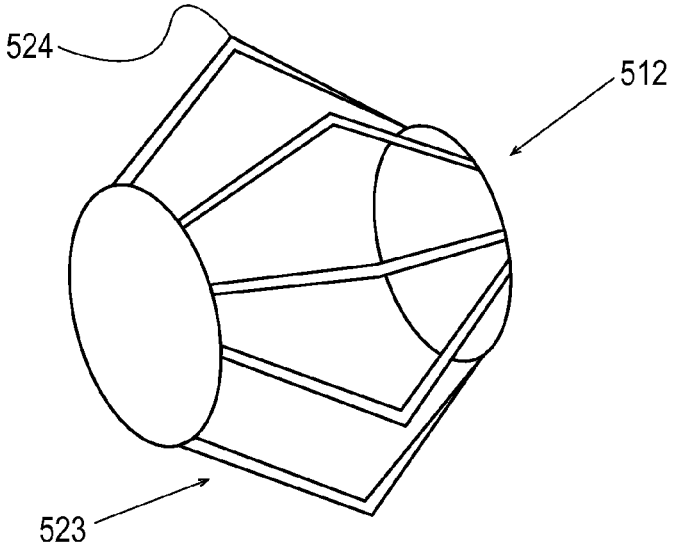

A pliable or compressible material may provide a suitable adjustable application roller, but it may be desirable to include a reinforcing structure in the roller to stabilize the shape of the roller when it is in a particular configuration. FIGS. 5A-5C show an exemplary embodiment of an adjustable application roller 512 that includes a plurality of ribs 523 extending therethrough. The ribs 523 are positioned under the application surface 522 at a predetermined depth, based on the thickness of the application surface 522 and provide additional stability and support. The ribs 523 may be formed from any suitable material known in the art, as long as they provide suitable stability and do not undesirably interfere with the compression and/or expansion of the adjustable application roller 512. As shown in FIG. 5B, each rib 523 may include first and second rib portions 526, 527, whose opposing ends are joined to compression elements 574, 576. The first and second rib portions 526, 527 may have equal or unequal lengths and may be hingedly joined to one another at or near the longitudinal center of the application roller 512. When the application roller 512 is fully expanded (i.e., not subjected to a compression force), as illustrated in FIG. 5A, the ribs 523 may extend axially across the entire length of the application roller 512. The ribs 523 can be rigid or flexibly resilient. In various embodiments, some or all of the resilient ribs can be pretensioned when the application roller 512 is adjusted to a widest roll face width.

FIG. 5B shows the exemplary adjustable application roller 512 of FIG. 5A without the surface 522. As the application roller 512 is compressed, as shown in FIG. 5B, the ribs 523 begin to bend radially outwardly at the hinges 524. When a pliable or compressible material is placed over the ribs 523 to form the surface 522, the pliable or compressible surface 522 will conform to the new position of the ribs, resulting in a shape change. FIG. 5C shows the adjustable application roller 512 of FIG. 5B being further compressed. As illustrated in FIG. 5C, the ribs 523 continue to bend radially outwardly at the hinges 524 and provide a stable framework over which a pliable surface material can be placed. In various alternate embodiments, the ribs 523 can be made from a resilient or elastic material, which may or may not be pretensioned between the ends of the roller.

Conventional dabbing applicators are not interchangeable or deformable to the extent desired for applying composition to a target surface having a variety of different contours and geometries, such as the face or body of a person. In addition there are times when the dabbing and wiping motions alone will not provide the texture and layered application desired for best performance of topical compositions for the skin. Thus, it would be desirable to provide an applicator that can predictably deposit a personal care composition to various contours of the body.

Figure 6A:
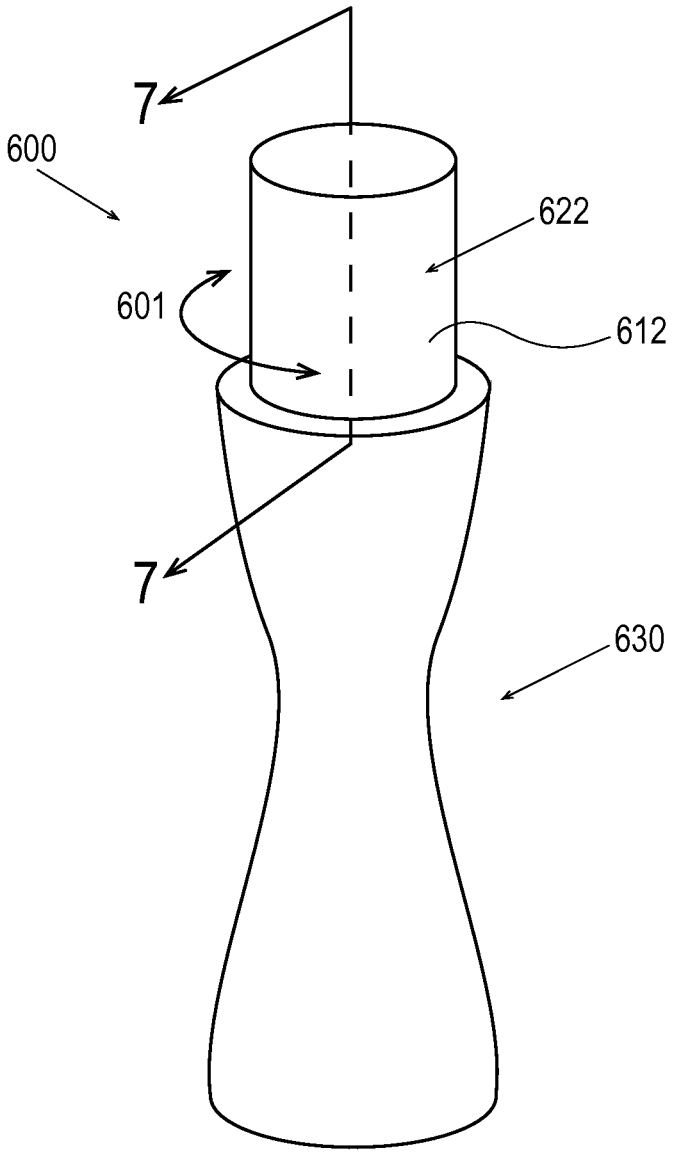
FIGS. 6A and 6B are perspective views of an embodiment of an applicator.
Figure 6B:
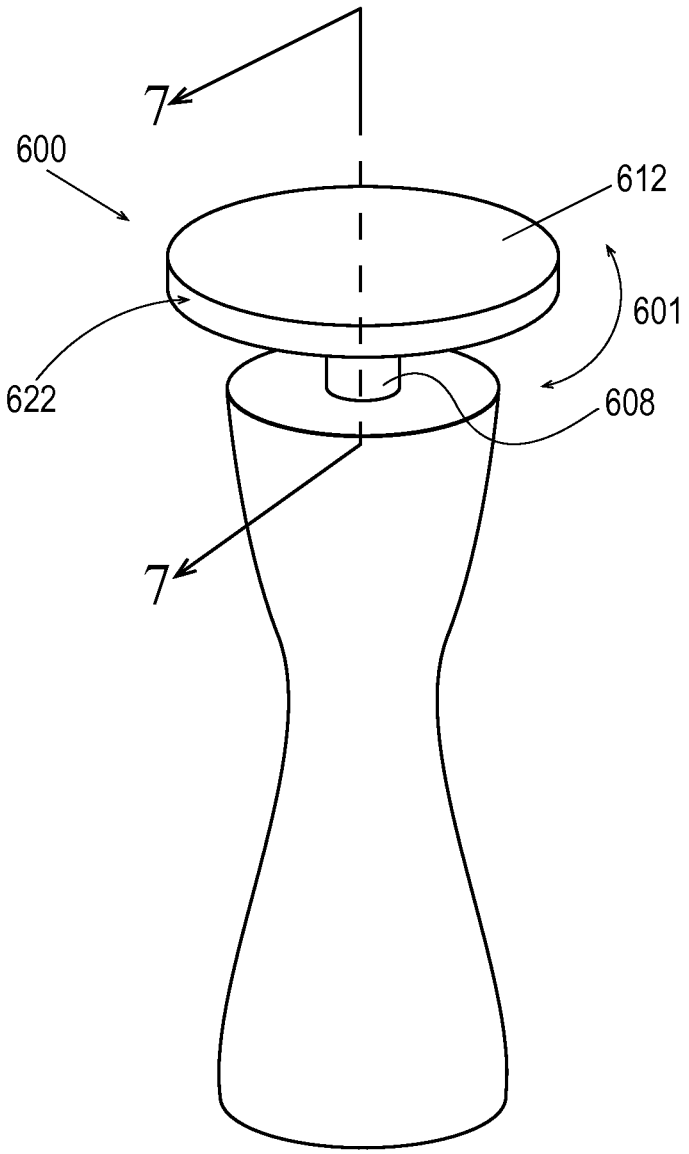

FIGS. 6A and 6B show an exemplary embodiment of an applicator 600 that includes a rotatable, adjustable application roller 612. The application roller 612 is rotatable in the direction indicated by the arrow 601. The adjustable application roller 612 may include a body 630, which is graspable by a user and includes an internal storage space suitable for receiving and storing one or more reservoirs containing personal care composition(s). As illustrated in FIG. 6A, the application roller 612 may have a first configuration that provides a relatively large surface 622 for receiving and applying a personal care composition. In contrast, FIG. 6B shows the application roller 612 in a second configuration with the application roller 612 compressed. The smaller surface 622 in FIG. 6B may be suitable for applying a personal care composition to particular portions of a user's face such as hard-to-reach areas. In certain embodiments, the applicator 600 may include a shaft 608 which enables the application roller 612 to rotate.

Figure 7:
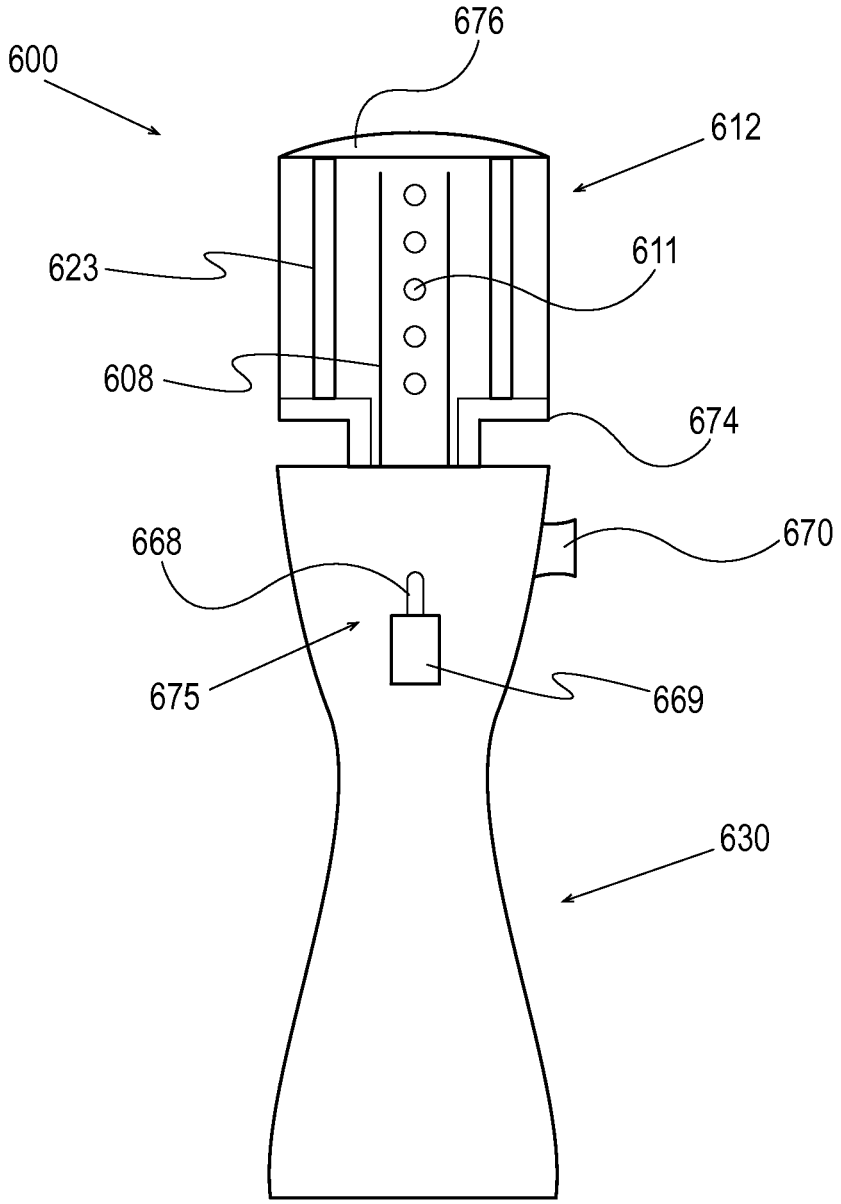
FIG. 7 is a partial section view of the applicator of FIG. 6A.

FIG. 7 shows a sectional view of the adjustable application roller 612 along line 7-7. As shown in FIG. 7, the application roller 612 may include one or more ribs 623 extending axially under the application surface 622. The shaft 608 may be configured as a hollow tube in liquid communication with one or more reservoirs in the body 630 of the applicator 600. Each of the one or more reservoirs may contain one or more personal care composition(s) (e.g., a cleaner and/or a foundation). Embodiments that include a solid shaft are also contemplated herein, and may include an alternate means of delivering the personal care composition to the surface 622 of the application roller 612 (e.g., external tubing, intermediate elements such as transport rollers, wicking material in liquid communication with the personal care composition and the application roller 612). The shaft 608, when configured as a tube-like structure, may also include one or more openings 611 through which the liquid personal care composition can exit the tube-like shaft 608 for transport to the application surface 622. In certain embodiments, the application roller 612 may be formed from a material such as foam or other porous/flexible surface materials that permits the flow of the personal care composition or even actively transports (e.g., via capillary action) the personal care composition from the openings 611 in the shaft to the application surface 622. In certain embodiments, a liquid personal care composition(s) may be urged through the tube-like shaft 608 by an airless pump such as one or more of the airless pumps described hereinabove. In such an example, the airless pump may be operated by pressing or squeezing a button 670 or lever disposed on the body 630 of the applicator. The pump may be manually or battery operated. The applicator 600 may include a pair of compression elements 674, 676 positioned on opposing ends (e.g., the top and bottom) of the application roller 612, as illustrated in FIG. 7. One or both of the compression elements 674, 676 may be movable. In certain embodiments, the bottom compression element 674 may be movable while the top compression element is fixed in a single position. For example, the bottom compression element 674 may move along the shaft 608 toward the top compression element 676 while the top compression element 676 is permanently joined to the shaft 608 or formed as a unitary element therewith. One or both compression elements 674, 676 may be moved toward one another by manipulating a position selector 675 positioned, e.g., on the body 630 of the applicator 600. In certain embodiments, the position selector may be in the form of a slidable arm or button 669 situated in a channel 668. When a user slides the arm or button 669 along the channel 668 from the starting position (i.e., where little or no compression is being applied to the application roller 612) to a second position, one or both compression elements 674, 676 move to apply a compressing force to the application roller 612, thereby causing a shape change.

Figure 8:
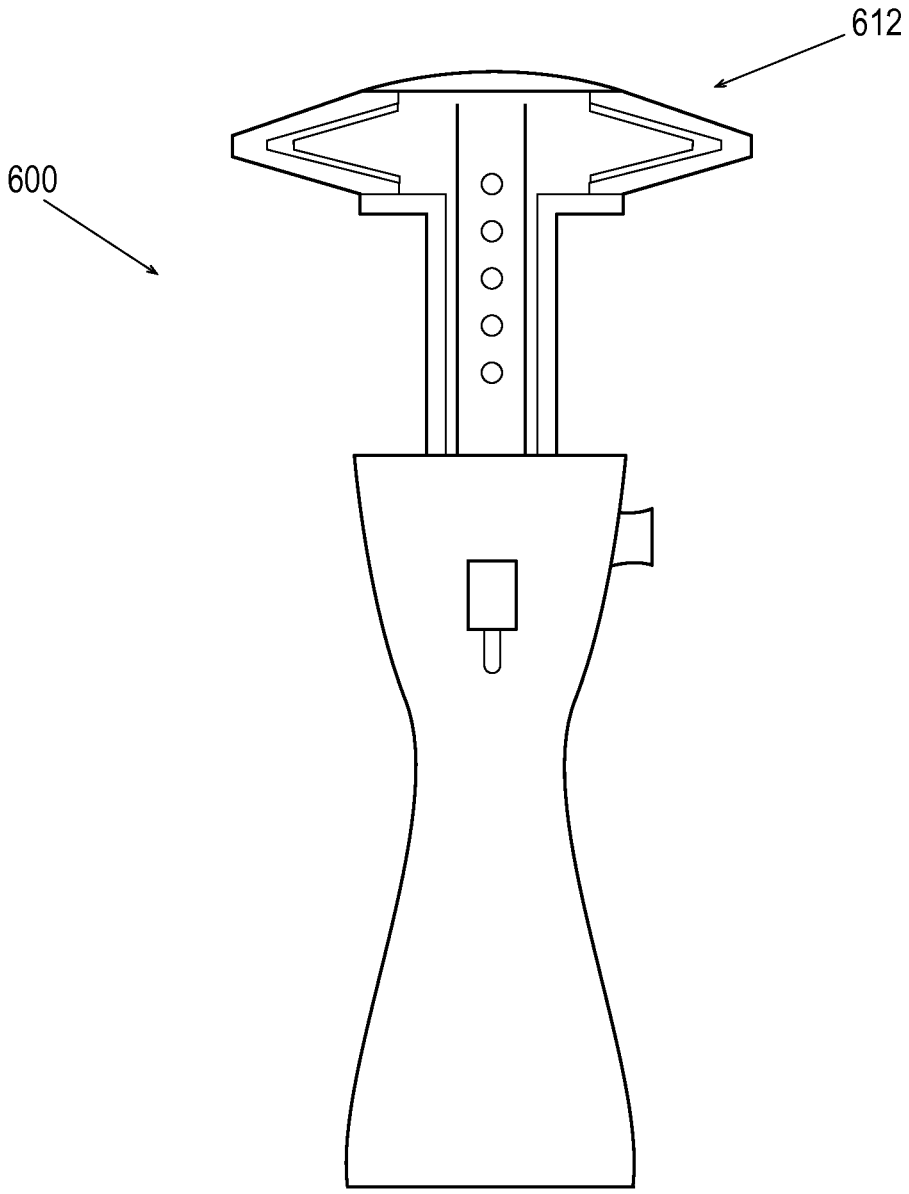
FIG. 8 is a partial section view of the applicator of FIG. 6B.

FIG. 8 illustrates an applicator 600 with the application roller 612 in a fully compressed configuration. The compressed application roller 612 may be returned to an uncompressed (partially or fully) configuration by sliding the arm or button 669 back to the starting position. It is to be appreciated that the adjustable application roller 612 may have any number of intermediate configurations (i.e., between being fully compressed and fully uncompressed), and the arm or button 669 may have a plurality of settings which correspond to such intermediate configurations.

Figure 9A:
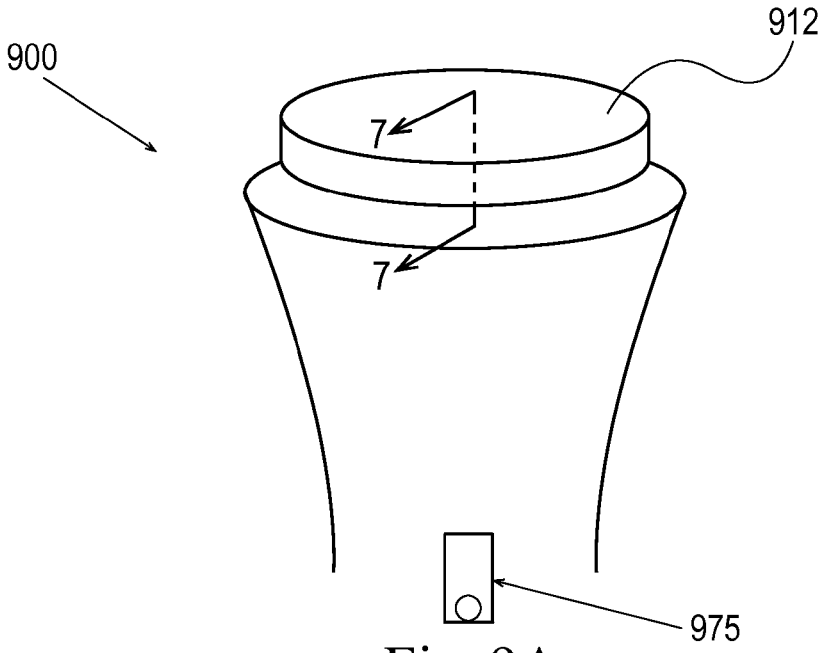
FIGS. 9A and 9B are partial perspective views of an embodiment of an applicator.

FIG. 9A shows an exemplary embodiment of an applicator 900 that includes an internal, adjustable positioning system, which can be manipulated by a user change the configuration of the application roller 912. As used herein in conjunction with the adjustable positioning system, the term "internal" means that at least a portion of the adjustable positioning system is disposed inside of the application roller 912. When the application roller 912 is formed from a pliable or expandable compressible material, the internal positioning system can change the shape of the roller 912, for example, from the disc-shape shown in FIG. 9A to the dome-shape shown in FIG. 9B or vice versa, when a user operates the positioning system as intended. In certain embodiments, the internal positioning system may include a manipulatable position selector 975 disposed on an external portion of the applicator 900 (e.g., on the body 930 of the applicator 900). The position selector 975 may include a first position and a second position, which can be freely selected by a user to switch between a first configuration and a second configuration. The first configuration may be suitable for applying a personal care composition to relatively large areas of the face and/or body, while the second configuration is more suited to applying a personal care composition to the hard-to-reach areas. Of course, it is to be appreciated that the positioning system may be configured to provide more than two different positions (e.g., 3, 4, 5, or any number of intermediate positions between a fully extended and fully compressed position), as desired.

Figure 9B:
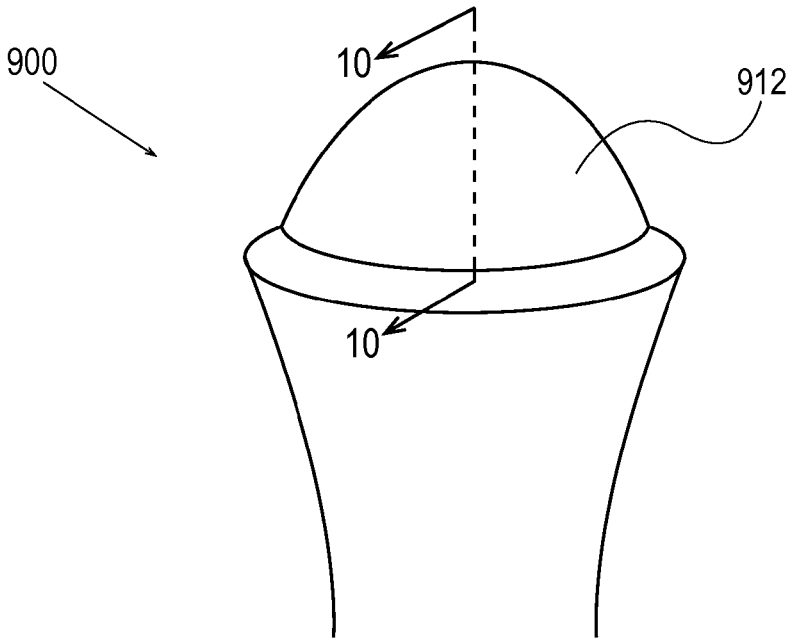
Figure 10:
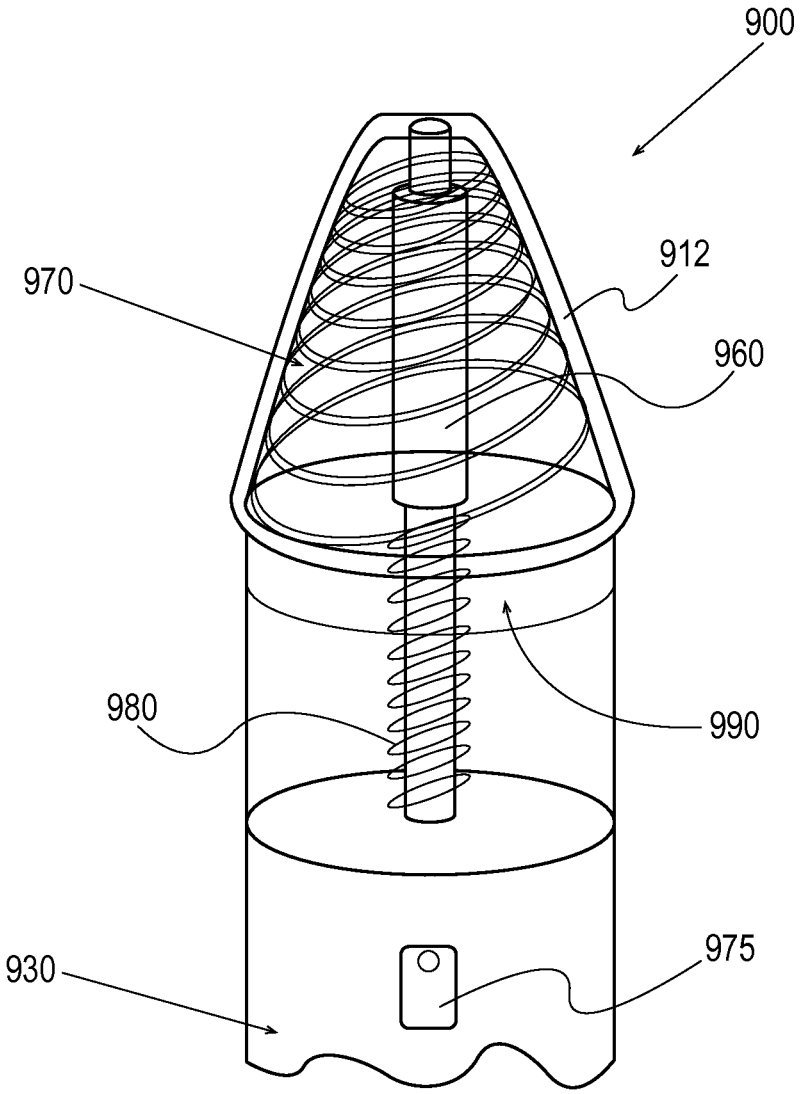
FIG. 10 is a partial section view of the applicator of FIG. 9B.

FIG. 10 shows a section view of the applicator 900 of FIG. 9B along line 10-10. As illustrated in the FIG. 10, the applicator 900 includes an internal, adjustable positioning system 990. The internal positioning system may include a position selector 975 mechanically coupled to the application roller 912 by one or more intermediate elements. As shown in FIG. 10, the internal positioning system 990 may include a fixed, threaded rod 980 that extends out of the center portion of the body 930. Positioned on the threaded rod 980 is movable positioning element 960 that rides up and down the threaded rod 980 in response to the position selector 975 being manipulated by a user. The movable positioning element 960 is joined to spring 970 (e.g., a conical compression spring or the like) and/or other elastic material, such that when the movable element 960 moves up the threaded rod 980, both the application roller 912 and the spring 970 move in the direction of the positioning element 960. In this example, a conical spring is used so that it extends into a conical shape that is similar to the conical shape of the expanded application roller 912. When extended, the spring 960 may provide a stable support structure similar to the ribs described hereinabove. Additionally, the spring 980 provides a counter force that helps return the application roller to a relaxed, unexpanded configuration when the position selector 975 is released. In certain embodiments, it may be desirable to provide a locking feature that prevents the application roller 912 from unintentionally returning to an unexpanded configuration.

Figure 11:
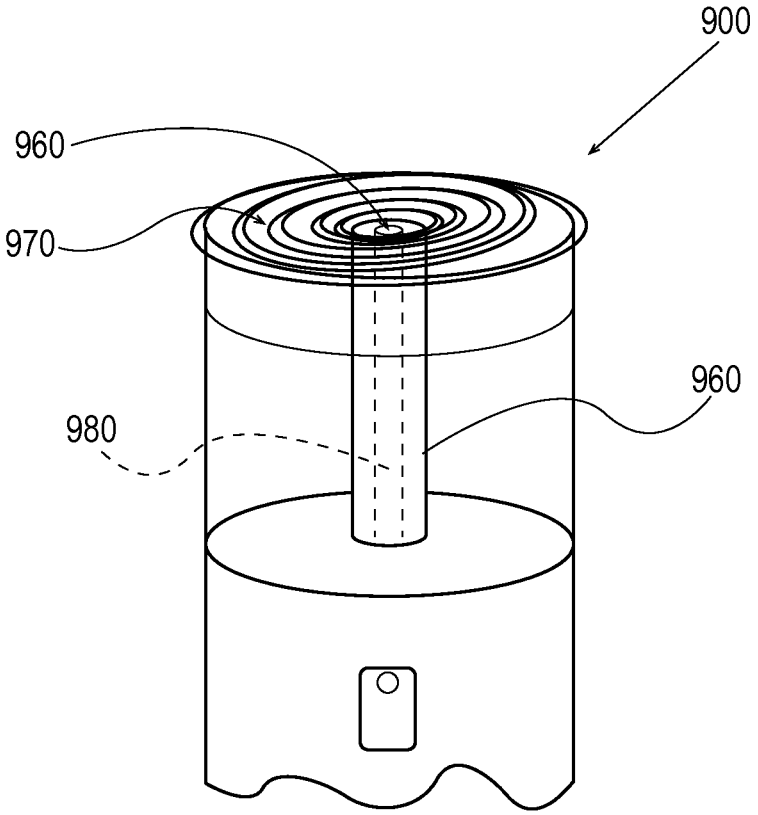
FIG. 11 is a partial section view of the applicator of FIG. 9A.

FIG. 11 shows a section view of the applicator 900 of FIG. 9A along line 7-7. As illustrated in FIG. 11, the applicator roller 912 is in an unexpanded configuration. The spring 980 may be selected to telescope into itself to provide a stable, substantially flat surface in the unexpanded configuration.

FIG. 12 shows an exemplary embodiment of an applicator 700 that includes a product collection system 750. The applicator 700 includes a reservoir 772 for storing a personal care composition that can be dispensed, for example, by an airless pump comprising an actuator 770 mechanically coupled to a piston 773. When the reservoir 772 is full, the piston 773 is positioned at the bottom of the reservoir 772, and as product is dispensed, for example, through a dispensing orifice 764 or the like, the piston 773 moves up and reduces the volume of the reservoir 772. The applicator may also include a collection system 750 for recovering excess personal care product disposed on the applicator surface and/or target skin surface. The collection system 750 includes a collection reservoir 755 disposed under the piston 773 for storing the collected personal care composition. As product is dispensed from the reservoir 772 the piston 773 moves up and the volume of the collection reservoir 755 increases, thereby creating a low or negative pressure condition (e.g., vacuum) in the collection reservoir 755. The collection system 750 includes a collection port 752 positioned proximate to the applicator surface (not shown) and/or target surface. The collection port 752 is in liquid communication with the collection reservoir 755 via a conduit 753. The low or negative pressure generated in the collection reservoir 755 is communicated to the collection port 752 such that the personal care composition proximate to the collection port 752 will be sucked in and transported to the collection reservoir 755 via the conduit 753. In certain embodiments, the collection system 750 may include a collection bar 751 or similar feature which functions to move the personal care composition toward the collection port 752. For example, the collection bar 751 may in the form of a retractable plastic piece.

The collection bar 751 is adjustable to different positions to allow for different engagements that can be skimmed along the bodily surface. In various embodiments, a collection bar can be spring-loaded. The collection bar 751 is linearly adjustable 751L to different extension lengths to allow for different engagements with a user's bodily surfaces. The collection bar 751 has a detent 751T, for a user to press on, when adjusting the extension length. The collection bar 751 can be configured to lock in place at each of the different extension lengths. The collection bar 751 can also be fully retractable, so as to not protrude from the body of the device. The collection bar 751 is configured to pivot 751R around a pivot point 751P to adjust to different angles to allow for different engagements with a user's bodily surfaces. In various embodiments, a pivotable collection bar can be configured to lock in place at different pivot positions. The collection bar 751 is also adjustable 751A to different positions around an outside of the body of the cosmetic device 700.

In various embodiments, the distal end of the collection bar can be configured with a collection bar end element shown generically as element 756 in FIG. 12. FIG. 12 shows a first exemplary collection bar end element 756A, which is a toothed applicator, for applying or removing areas of high and low deposition. FIG. 12 also shows a second exemplary collection bar end element 756B, which is a razor, for shaving hair. FIG. 12 further shows a third exemplary collection bar end element 756C, which is an abrasive element, for abrading skin. Further, a collection bar end element can also be: a hair comb, a bristled brush, a textured surface, and a fabric material. A collection bar end element can take on various other forms (including combinations of any elements disclosed herein) for applying a composition and/or mechanically treating a bodily surface. The collection bar end element 756 is configured to pivot 756R around a pivot point 756P that is disposed proximate to a distal end of the collection bar 751. In various embodiments, a pivotable collection bar end element can be configured to lock in place at different pivot positions.

A collection bar end element can be disposed on any part of the applicator in any useful orientation. A collection bar can be located on either side of an applicator, on the top, bottom, or side. Further, an applicator can include more than one collection bar, configured in any way described herein.

Personal Care Composition

In certain embodiments, it may be desirable to provide a personal care composition, cosmetic foundation or concealer in the present applicator. Suitable examples of cosmetic foundations and concealers are disclosed in copending U.S. Provisional Ser. No. 61/367,230, filed by Hodgson, et al., Jul. 23, 2010. Exemplary foundations and/or concealers may include one or more film forming polymer(s), sunscreen active(s), plasticizing solvents, particles, oils, emulsifiers, elastomers, pigments, and other ingredients commonly incorporated into cosmetic foundations and concealers, which are described in more detail below.

Film Forming Polymer

Suitable film forming polymers for use herein are capable of forming a thin elastomeric film on skin. The film forming polymer may be selected to provide a finished foundation or concealer that has a glass transition temperature (Tg) of between 18° C. and 38° C. (e.g., between room temperature and body temperature). "Glass transition temperature" or "Tg" generally refers to the temperature where a polymer softens or transitions from brittle to plastic, in the absence of plasticizers. This provides for a flexible polymer during application and wear. When the Tg is too high, the foundation may be hard to apply, and may flake. If it is too low, the foundation will be less adhesive (and perhaps more cohesive) and will tend to "ball up" on application. Polymers suitable for use herein may be thermoplastic, rather than thermosetting. Additionally, the polymer should be selected to provide an aqueous phase that is fluid enough to be handled and reasonably incorporated into the final emulsion composition as the dispersed or internal phase. Nonlimiting examples of film-forming polymers include sulfopolyester resins such as AQ sulfopolyester resins (e.g., AQ29D, AQ35S, AQ38D, AQ38S, AQ48S, and AQ55S available from Eastman Chemicals); Vinex resins, such as Vinex 2034, Vinex 2144, and Vinex 2019 available from Air Products; water dispersible acrylic resins such as Dermacryl® resins available from Azko Nobel; polyquaterniums such as those available from Guangzhou Tinci Materials Technology Co., Ltd. and Nalco Company; polyurethanes (e.g., Baycusan® C1000 series from Bayer Materials Sciences Co), polyvinylpyrrolidones ("PVP"), including Luviskol® K17, K30 and K90 available from BASF; water soluble copolymers of PVP, including PVP/VA S-630 and W-735 and PVP/dimethylaminoethylmethacrylate copolymers (e.g., Copolymer 845 and Copolymer 937 available from ISP). Particularly suitable polymers include AQ38S and PVP. Typically, the polymer is present at levels of from 0.5% to 10% by weight based on the weight of the cosmetic composition, for example, from 1% to 8%.

Sunscreen Active

A sunscreen active is an ingredient or composition that absorbs or reflects at least some of the sun's ultraviolet (UV) radiation and is typically incorporated into a topical product for skin. Sunscreen actives can be organic or inorganic. Organic sunscreen actives may be hydrophilic organic sunscreen actives, hydrophobic organic sunscreen actives, and mixtures thereof. A particularly suitable sunscreen active is a UV absorbing organic sunscreen active present at, for example, from 0.1% to 16%, from 0.2% to 12%, or even from 0.5% to 8% by weight based on the weight of the composition. Exemplary sunscreen actives are described in the CTFA International Cosmetic Ingredient Dictionary and Handbook, $7^{th}$ edition volume 2, pp. 1672, edited by Wenning and Mc Ewen (The Cosmetic, Toiletry, and Fragrance Association, Inc., Washington, D.C. 1997).

Nonlimiting examples of inorganic sunscreen actives include titanium dioxide and zinc oxide particles. Such metal oxide particles may have an average primary particle size equal to or less than 100 nm. These particles may be selected from sunscreen grade titanium dioxide, sunscreen grade zinc oxide and mixtures thereof. These particles may be surface-treated and/or coated, using conventional treatments. Examples of commercially available sunscreen metal oxide particles include M262 from Kemira Corp., TTO S-3 and TTO S-4 from Ishihara Corp. The composition may include from 0.05% to 15%; 0.5% to 10%; or even from 1% to 5% of sunscreen grade metal oxide particles by weight of the total composition.

Suitable examples of hydrophobic organic sunscreen actives include, without limitation, cinnamate derivatives (e.g., ethylhexyl methoxycinnamate and ethyl methoxycinnamate); alkyl β,β-diphenylacrylate derivatives (e.g., ethyl 2-cyano-3,3-diphenylacrylate) and 2-ethylhexyl 2-cyano-3,3-diphenylacrylate); α-cyano β,β-diphenulacrylate derivatives; anthranilate derivatives (e.g., methyl anthranilate); benzophenone derivatives (e.g., methyl benzophenone and trimethylbenzophenone); camphor derivatives (e.g., benzylidene camphor sulfonic acid); dibenzoylmethane derivatives (e.g., butyl methoxydibenzoylmethane, ethylhexyl methoxydibenzoylmethane, and isopropyl dibenzoylmethane); p-aminobenzoic derivatives (e.g., p-aminobenzoic acid butyl ester and p-aminobenzoic acid); salicylic derivatives, triazine derivatives (tris-biphenyl triazine); and mixtures thereof. Particularly suitable hydrophobic organic sunscreen actives are selected from 2-ethylhexyl-p-methoxycinnamate, 4-(1,1-dimethylethyl)-4'-methoxydibenzoylmethane; 4-isopropyldibenzoylmethane; 4-(1,1-dimethylethyl)-4'-methoxydibenzoylmethane, 2-ethylhexyl-2-cyano-3,3-diphenylacrylate, or mixture thereof. 4-(1,1-dimethylethyl)-4'-methoxydibenzoylmethane, also known as butyl methoxydibenzoylmethane or Avobenzone, is commercially available Parsol™ 1789 from Givaudan Roure S. A. and Eusolex™ 9020 from Merck & Co., Inc. 4-isoproplydibenzoylmethane, also known as isopropyldibenzoylmethane, is commercially available as Eusolex™ 8020 from Merck & Co., Inc. 2-ethylhexyl-2-cyano-3,3-diphenylacrylate, also known as Octocrylene, is commercially available as Uvinul N539 SG from BASF; and Eusolex OCR from Rona/Merck. Examples of commercially available 2-ethylhexyl-p-methoxycinnamate, also known as Octyl Methoxy Cinnamate, include Uvinul MC80 from BASF and Neo Heliopan AV from Symrise.

A suitable example of a hydrophilic organic sunscreen active is 2-phenylbenzimidaole-5-sulfonic acid, also known as PBSA2-phenylbenzimidaole-5-sulfonic acid is commercially available under the product name Eusolex 232 from Rona/Merck. The composition may include from 0.1% to 16%, from 0.2% to 12%, from 0.5% to 10%, or even 0.5% to 7% of at least one organic sunscreen active by weight of the total composition.

Plasticizing Solvent

Plasticizing solvents are slow-evaporating, water-miscible or dispersible cosolvents that are generally recognized as safe. A wide variety of plasticizing solvents are listed in the CTFA International Cosmetic Ingredient Dictionary and Handbook, 3rd Ed., Cosmetic and Fragrance Assn., Inc., Washington D.C. (1982) pp. 575-580. Particularly suitable plasticizing solvents include slow evaporating glycols and glycol ethers such as, for example, propylene glycol; butylene glycol; hexylene glycol; glycerine; dipropylene glycol; dipropylene glycol methyl ether (commonly known as DPM); propylene glycol phenyl ether; and polyethylene glycols (PEGs) such as PEG 4 and PEG 8. Other exemplary solvents include propylene carbonate, dimethyl isosorbide, and mixtures thereof. The plasticizing solvent may be present in amounts of from 0.5% to 30% or even 5% to 20%, and generally appear in a ratio of solvent to polymer of from 10:1 to 1:1 or even 8:1 to 2:1. The plasticizing solvent is chosen to provide for water co-solvency, suitable solubility regarding the polymer, low volatility, stability, and safety (i.e., lack of toxicity). Thus, the cosmetic composition herein employs safe solvents that provide little or no sensation of tackiness or cooling (usually due to evaporation) on the applied area. The plasticizing solvent may be chosen such that the polymer and plasticizing solvent are in the aqueous phase of the emulsion, thereby diminishing any tacky sensation of polymer contacting the user's hands and fingers during the cosmetic's initial application. Because the solvent exhibits a slow evaporation rate and is present in the aqueous phase, it helps extend the workability of the foundation and delays any perceived onset of tackiness for up to two minutes.

Particles

Particles may be included herein to modify the application and appearance of the film. Additionally, the particles may be added to extend the wear of the foundation film by absorbing components of sebum and sweat and thereby limiting the mobility of the foundation film across skin. The amount of particles present is important because too few particles may result in a cosmetic composition that exhibits an undesirable shine when applied to the skin. On the other hand, when the cosmetic composition includes too many particles, it may exhibit an undesirable chalky appearance when applied to the skin. Thus, it may be desirable to provide suitable particles at an amount of from 0.01% to 40%, from 0.1% to 30%, from 0.5% to 10%, or even 1-7.5% by weight, based on the weight of the cosmetic composition. Materials suitable for forming the particles herein include silicas, starch materials, ethylene methacrylate copolymers and mixtures of these. For example, spherical silica (Spheron P1500, Spheron L1500, Spheron LC-KAA, Spheron 20MB) from Presperse Chemicals), hydrated silica, silicone treated silica beads, mica, talc, nylon 12 and nylon 6 (Orgasol series from Lipo Chemicals), polyethylene, aluminium starch octenyl succinate (Dry Flo, Dry Flo Plus from National Starch), methylsilsequioxane resin microspheres, (Tospearl 145A or Tospearl 2000 from Momentive Performance Materials); Micropearl M 100 (microspheres of polymethylmethacrylates) from Seppic; Trefil E 506C or Trefil E 505C (particles of crosslinked polydimethylsiloxanes) from Dow Corning Toray Silicone, Orgasol 2002D Nat C05 (particles of polyamide) from Atochem, Dynospheres (polystyerene microspheres) from Dyno Particles, FloBeads & microsphere complexes based off ethylene methacrylate copolymer (SPCAT12, SPCM12, DSPCS Series sold by Kobo Products), Microthene (polyethylene), Micropoly 220 (polyethylene), silica, or mixtures thereof. Styrene/DVB copolymers (Ganzpearl GS-0605 and GS-0805 from Presperse), PTFE (Microslip 519 from Presperse), PMMA (SUNPMMA-COCO0130 from Sunjin are also suitable.

Other particles that may be optionally present include iron oxide particles having an average surface area from 30 $m^2/g$ to 150 $m^2/g$, from 50 $m^2/g$ to 150 $m^2/g$, or even from 60 $m^2/g$ to 150 $m^2/g$. These particles are transparent particles being conventionally used in cosmetic compositions. It is to be appreciated that these particles are not pigmentary grade particles. The non-pigmentary iron oxide particles may have an average primary particle size of less than or equal to 100 nm, as measured by transmission electron microscopy. The non-pigmentary iron oxide particles may be selected from transparent yellow iron oxide particles, transparent red iron oxide particles, transparent black iron oxide particles, and mixture thereof. Transparent yellow iron oxide is also known as goethite, ferric oxide hydrate or CI 77492. Transparent red iron oxide is also known as haematite, ferric oxide and CI 77491. Transparent black iron oxide is known as magnetite, ferrous-ferric oxide and CI 77499. Examples of commercially available transparent iron oxide particles include FAF40TRR, FAF40TRY, CM3F30TRR, CM3F40TRR, CM3F30TRY and CM3F40TRY supplied by Kobo; Trionix® materials from Noviant; and, the SunChroma® materials from Sun Chemicals. The non-pigmentary iron oxide particles may be present at levels of from 0.05% to 10%, from 0.1% to 5%, or even from 0.1% to 4%, by weight based on the weight of the total composition.

Oil

One or more oils may be included to the foundation or concealer to act as a "carrier solvent" for the other formula components and allow for the formula to be spread around the face in a coherent manner. The oil may be a volatile oil, non-volatile oil or mixtures thereof. The term "non-volatile oil" includes oils that fulfill at least one of the following definitions: (a) the oil exhibits a vapor pressure of no more than 0.2 mm Hg at 25° C. and one atmosphere pressure; or (b) the oil has a boiling point at one atmosphere of at least 300° C. The oil may be present in an amount of from 1% to 80%, from 10% to 70%, or even from 15% to 65%, by weight based on the cosmetic composition. Optionally, the cosmetic composition may include from 0.1% to 20% or from 1 to 10% by weight of a non-volatile oil based on the weight of the cosmetic composition. The oil may include volatile, non-polar oils; non-volatile, relatively polar oils; non-volatile, non-polar oils; and/or non-volatile paraffinic hydrocarbon oils.

Emulsifier

Emulsifiers or surfactants may be included to provide emulsion stability and/or improved skin feel. The emulsifiers may be nonionic, anionic or cationic and may be present at levels of from 0.01% to 10%, from 0.1% to 10%, or even from 0.1% to 5% of emulsifiers by weight, based on the weight of the cosmetic composition. Suitable emulsifiers are disclosed in, for example, U.S. Pat. No. 3,755,560, issued Aug. 28, 1973, Dickert et al.; U.S. Pat. No. 4,421,769, issued Dec. 20, 1983, Dixon et al.; and McCutcheon's Detergents and Emulsifiers, North American Edition, pages 317-324 (1986). Illustrative nonionic surfactants are alkoxylated compounds based on C10-C22 fatty alcohols and acids, and sorbitan. These materials are available, for instance, from the Shell Chemical Company under the Neodol trademark, Copolymers of polyoxypropylene-polyoxyethylene, sold by the BASF Corporation under the Pluronic trademark, are sometimes also useful. Alkyl polyglycosides available from the Henkel Corporation may also be utilized herein. Anionic type emulsifiers or surfactants include fatty acid soaps, sodium lauryl sulphate, sodium lauryl ether sulphate, alkyl benzene sulphonate, mono- and di-alkyl acid phosphates and sodium fatty acyl isethionate. Amphoteric emulsifiers or surfactants include such materials as dialkylamine oxide and various types of betaines (such as cocamidopiopyl betaine). Other examples of suitable emulsifiers can be found in U.S. Pat. No. 5,085,856 to Dunphy et al.; Japanese Patent Publication Sho 61-83110; European Patent Application EP 522624 to Dunphy et al.; U.S. Pat. No. 5,688,831 to El-Nokaly et al.; and Examples of suitable moistures can be found in Cosmetic Bench Reference, pp. 1.22, 1.24-1.26 (1996).

When the cosmetically acceptable carrier is a water-in-silicone emulsion, emulsifiers may be selected from polyoxyalkylene copolymers, polyglyceryl copolymers or mixtures thereof. Polyoxyalkylene copolymers, also known as silicone polyethers, are described in detail in U.S. Pat. No. 4,268,499. Examples of commercially available polyoxyalkylene copolymers include DC5225C or DC2-5185C (PEG/PPG-18/18 dimethicone available as blend with cyclopentasiloxane) from Dow Corning Corp.; and, KF6017, KF6028 (PEG-9 dimethicone) or KF6038 from Shin-Etsu Inc. Examples of commercially available polyglyceryl emulsifiers include KF6100 and KF6104 from Shin-Etsu Inc.

Elastomers

Elastomers may be included to modify the skin feel of the composition as well as the optical properties of the composition. The elastomer may be, for example, a cross-linked organopolysiloxane elastomer selected from emulsifying cross-linked organopolysiloxane elastomer, non-emulsifying cross-linked organopolysiloxane elastomer or mixtures thereof. The term "non-emulsifying" when employed in relation to the cross-linked organopolysiloxane elastomer means a cross-linked organopolysiloxane elastomer comprising no polyoxyalkylene or polyglyceryl unit. The term "emulsifying" when employed in relation to the cross-linked organopolysiloxane elastomer means a cross-linked organopolysiloxane elastomer comprising at least one polyoxyalkylene (e.g., polyoxyethylene or polyoxypropylene) or polygyceryl unit.

The present cosmetic compositions disclosed herein may comprise from 0.01% to 15%, from 1% to 12.5%, or even from 2% to 10% by weight of a cross-linked organopolysiloxane elastomer based on the weight of the cosmetic composition. The composition may optionally include from 0.01% to 15% or even from 0.01% to 1% by weight of an emulsifying cross-linked organopolysiloxane elastomer based on the weight of the cosmetic composition and/or from 0.01% to 15% or even from 2% to 10% by weight of a non-emulsifying cross-linked organopolysiloxane elastomer based on the weight of the total composition.

Suitable non-emulsifying cross-linked organopolysiloxane elastomers include, without limitation, dimethicone/vinyl dimethicone crosspolymers. Examples of commercially available dimethicone/vinyl dimethicone crosspolymers are DC 9040, DC 9045 and DC 9041 from Dow Corning Corporation; SFE 839 from General Electric; KSG-15, KSG-16 and KSG-18 from Shin Etsu Chemical Company Ltd; and Gransil™ line of materials from Grant Industries. Examples of commercially available lauryl dimethicone/vinyl dimethicone crosspolymers include KSG-31, KSG-32, KSG-41, KSG-42, KSG-43, and KSG-44 from Shin Etsu Chemical Company Ltd. Suitable emulsifying cross-linked organopolysiloxane elastomers are polyoxyalkylene-modified elastomers formed from divinyl compounds, particularly siloxane polymers with at least two free vinyl groups, reacting with Si—H linkages on a polysiloxane backbone. Examples of commercially available emulsifying cross-linked organopolysiloxane elastomers include KSG-21 and KSG-210 and KSG-320 from the Shin-Etsu Chemical Company Ltd. Examples of commercially available emulsifying cross-linked organopolysiloxane elastomers comprising polyglyceryl units include KSG 710 and KSG-800 from the Shin-Etsu Chemical Company Ltd.

Pigment

Pigments may be included in the form of, for example, pigmentary metal oxide particles. Such metal oxide particles may be selected from pigmentary grade iron oxide particles and pigmentary grade titanium dioxide particles. Metal oxide particles provide coverage and colour to the skin. The pigmentary iron oxide particles have an average primary particle size of greater than 100 nm but typically less than 500 nm. These particles may be selected from pigmentary yellow iron oxide particles, pigmentary red iron oxide particles, pigmentary black iron oxide particles or mixture thereof. The pigment particles may be surface-treated and/or coated, using conventional treatments. Examples of commercially available pigmentary iron oxide particles include Cosmetic Red Iron Oxide C7054, Cosmetic Yellow Iron Oxide C7055, Unipure Black LC989 AS-EM from LCW-Sensient Cosmetic Technologies. The composition may comprise from 0.05% to 15%, preferably 0.1% to 12%, even more preferably 0.5% to 10%, pigmentary iron oxide particles by weight of the total composition.

Also suitable for use herein are iron containing titanium dioxide particles that serve to reduce blue reflectance from skin, as taught in copending US Publication Nos. 2010-0074928 A1, US 2010-0003205 A1, and US 2010-0003293 A1. Iron containing titanium dioxide particles may be present at levels of from 0.05% to 20%, from 1% to 15%, from 2% to 12.5%, or even from 3% to 10%, by weight of the total composition. The proportion of these particles may vary depending on the desired level of coverage and/or shade of the product. For example, to minimise shininess when the cosmetic composition is expected to be used onto darker skins for obtaining a high coverage, it may be desirable that the composition include a relatively high proportion of iron-containing titanium dioxide particles, for example from 5% to 10% by weight of such particles based on the weight of the cosmetic composition.

Fragrance

In addition, the composition may comprise fragrance. Whilst not wishing to be bound by theory, it is believed that extending the life of the fragrance by using a fragrance technology helps reinforce the long wear benefits of the foundation. Suitable fragrance technologies include cyclodextrins (beta, gamma, alpha and derivatives), plus those whereby the fragrance is entrapped within solid entrapping particles as described in US20090098170 A1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Additionally, properties described herein may include one or more ranges of values. It is to be understood that these ranges include every value within the range, even though the individual values in the range may not be expressly disclosed.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cosmetic applicator, comprising a handle with an elongated direction, and a rotatable application roller joined to the handle, wherein the application roller includes two ends, a deformable roll face, which includes an application surface, disposed between the ends, and an axis of rotation extending from one end to the other end, wherein the roll face is configured with an adjustable roll face width, such that the roll face width is adjustable in a direction that is measured parallel to the axis of rotation and between the ends;

wherein said applicator comprises a transfer roller, wherein an outside of the transfer is configured to receive a personal care composition, and wherein the outside of the transfer roller contacts the application surface of the application roller; and wherein the application roller includes a reinforcing structure which includes a plurality of rigid ribs, disposed inside of the roll face, under the pliable material; and wherein each of the rigid ribs includes at least one hinge, configured to bend outward, away from the axis of rotation.

2. The cosmetic applicator of claim 1, wherein the application roller is configured to adjust to at least two different roll face widths.

3. The cosmetic applicator of claim 1, wherein the application roller is configured to adjust to a widest roll face width such that the roll face has an overall shape that is cylindrical.

4. The cosmetic applicator of claim 1, wherein the roll face is made from a compressible material.

5. The cosmetic applicator of claim 1, wherein the roll face is made from a pliable material.

6. The cosmetic applicator of claim 5, wherein the roll face is made from an elastic material.

7. The cosmetic applicator of claim 1, wherein the application surface includes a three-dimensional pattern.

8. The cosmetic applicator of claim 1, wherein the application surface includes an abrasive pattern.

9. The cosmetic applicator of claim 1, wherein the application surface includes a pattern of apertures.

* * * * *